US008223988B2

(12) United States Patent
Wang et al.

(10) Patent No.: US 8,223,988 B2
(45) Date of Patent: Jul. 17, 2012

(54) ENHANCED BLIND SOURCE SEPARATION ALGORITHM FOR HIGHLY CORRELATED MIXTURES

(75) Inventors: Song Wang, San Diego, CA (US); Dinesh Ramakrishnan, San Diego, CA (US); Samir Gupta, San Diego, CA (US); Eddie L. T. Choy, Carlsbad, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1206 days.

(21) Appl. No.: 12/022,037

(22) Filed: Jan. 29, 2008

(65) Prior Publication Data

US 2009/0190774 A1 Jul. 30, 2009

(51) Int. Cl.
*H04R 3/00* (2006.01)
*H04R 1/02* (2006.01)
*H04R 9/06* (2006.01)

(52) U.S. Cl. ..... 381/92; 381/334; 381/111; 381/122

(58) Field of Classification Search ..... 382/92; 381/92, 334, 94, 111, 122, 150, 103, 66
See application file for complete search history.

(56) References Cited

U.S. PATENT DOCUMENTS 5,276,779 A * 1/1994 Statt ..... 358/1.9
5,539,832 A 7/1996 Weinstein et al.
5,825,671 A 10/1998 Deville
6,526,148 B1 2/2003 Jourjine et al.
6,694,020 B1 2/2004 Benesty
6,904,146 B2 6/2005 Domer et al.
7,020,294 B2 3/2006 Lee et al.
7,099,821 B2 8/2006 Visser et al.
7,359,504 B1 4/2008 Reuss et al.
7,464,029 B2 12/2008 Visser et al.
7,496,482 B2 2/2009 Araki et al.
7,630,502 B2 12/2009 Beaucoup et al.

(Continued)

FOREIGN PATENT DOCUMENTS

EP 0548054 A2 6/1993

(Continued)

OTHER PUBLICATIONS

International Preliminary Report on Patentability—PCTAJS2009/032414—International Search Authority—European Patent Office—May 10, 2010.

(Continued)

*Primary Examiner* — Chuong A. Luu
(74) *Attorney, Agent, or Firm* — Espartaco Diaz Hidalgo

(57) ABSTRACT

An enhanced blind source separation technique is provided to improve separation of highly correlated signal mixtures. A beamforming algorithm is used to precondition correlated first and second input signals in order to avoid indeterminacy problems typically associated with blind source separation. The beamforming algorithm may apply spatial filters to the first signal and second signal in order to amplify signals from a first direction while attenuating signals from other directions. Such directionality may serve to amplify a desired speech signal in the first signal and attenuate the desired speech signal from the second signal. Blind source separation is then performed on the beamformer output signals to separate the desired speech signal and the ambient noise and reconstruct an estimate of the desired speech signal. To enhance the operation of the beamformer and/or blind source separation, calibration may be performed at one or more stages.

40 Claims, 10 Drawing Sheets

U.S. PATENT DOCUMENTS

| | | | | |
|---|---|---|---|---|
| 7,653,537 | B2 | 1/2010 | Padhi et al. | |
| 7,817,808 | B2 | 10/2010 | Konchitsky et al. | |
| 2002/0172374 | A1 | 11/2002 | Bizjak | |
| 2003/0061185 | A1 | 3/2003 | Lee et al. | |
| 2003/0179888 | A1 | 9/2003 | Burnett et al. | |
| 2005/0105644 | A1 | 5/2005 | Baxter et al. | |
| 2006/0013101 | A1 | 1/2006 | Kawana et al. | |
| 2006/0053002 | A1 | 3/2006 | Visser et al. | |
| 2006/0080089 | A1 | 4/2006 | Vierthaler et al. | |
| 2007/0257840 | A1 | 11/2007 | Wang et al. | |
| 2009/0106021 | A1 * | 4/2009 | Zurek et al. | 704/226 |

FOREIGN PATENT DOCUMENTS

| | | | |
|---|---|---|---|
| EP | 0729288 | A2 | 8/1996 |
| EP | 0784311 | A1 | 7/1997 |
| EP | 0785419 | A2 | 7/1997 |
| JP | 11298990 | A | 10/1999 |
| JP | 2003005790 | A | 1/2003 |
| JP | 2003333698 | A | 11/2003 |
| JP | 2004274683 | A | 9/2004 |
| JP | 2005227512 | A | 8/2005 |
| JP | 2006510069 | A | 3/2006 |
| JP | 2007193035 | A | 8/2007 |
| JP | 2008507926 | A | 3/2008 |
| RU | 2291499 | | 1/2007 |
| WO | WO9711538 | | 3/1997 |
| WO | WO0195666 | A2 | 12/2001 |
| WO | WO02093555 | | 11/2002 |
| WO | WO2004008804 | | 1/2004 |
| WO | WO2006132249 | A1 | 12/2006 |

OTHER PUBLICATIONS

International Search Report and Written Opinion—PCT/US2009/032414, International Search Authority—European Patent Office—Jun. 26, 2009.

Pan, Qiongfeng; Aboulnasr, Tyseer: "Combined Spatiau Beamforming and Time/Frequency Processing for Blind Source Separation"!3. European Signal Processing Conference, 4.-8.9. 2005, Antalya Sep. 8, 2005, Retrieved from the Internet:URL:http://www.eurasip.org/Proceedings/Eusipco/Eusipco2005/defevent/papers/cr1353.pdf [retrieved on Jun. 4, 2009].

Amari, S. et al. "A New Learning Algorithm for Blind Signal Separation." In: Advances in Neural Information Processing Systems 8 (pp. 757-763). Cambridge: MIT Press 1996.

Anand, K. et al.: "Blind Separation of Multiple Co-Channel BPSK Signals Arriving at an Antenna Array," IEEE Signal Processing Letters 2 (9), pp. 176-178, Sep. 1995.

B. D. D Van Veen, "Beamforming: A versatile approach to spatial filtering," IEEE Acoustics, Speech and Signal Processing Magazine, pp. 4-24, Apr. 1988.

Barrere J., et al., "A Compact Sensor Array for Blind Separation of Sources," IEEE Transactions on Circuits and Systems-I: Fundamental Theory and Applications, 2002, 49 (5), 565-574.

Bell, A. et al.: "An Information-Maximization Approach to Blind Separation and Blind Deconvolution," Howard Hughes Medical Institute, Computational Neurobiology Laboratory, The Salk Institute, La Jolla, CA USA and Department of Biology, University of California, San Diego, La Jolla, CA USA., pp. 1129-1159.

Belouchrani A., et al., "Blind Source Separation Based on Time-Frequency Signal Representations," IEEE Transactions on Signal Processing, 1998, 46 (11), 2888-2897.

Benesty, J. et al.: "Advances in Network and Acoustic Echo Cancellation," pp. 153-154, Springer, New York, 2001.

Breining, C. et al.: "Acoustic Echo Control An Application of Very-High-Order Adaptive Filters," IEEE Signal Processing Magazine 16 (4), pp. 42-69.

Cardoso, J.F.: "Blind Signal Separation: Statistical Principles," ENST/CNRS 75634 Paris Cedex 13, France, Proceedings of the IEEE, vol. 86, No. 10, Oct. 1998.

Cardoso, J.F.: "Source Separation Using Higher Order Moments," Ecole Nat. Sup. Des Telecommunications-Dept Signal 46 rue Barrault, 75634 Paris Cedex 13, France and CNRS-URS 820, GRECO-TDSI, ICASSP, IEEE International Conference on Acoustics, Speech and Signal Processing—Proceedings 4, pp. 2109-2112, 1989.

Cardoso, J.F.: "The Invariant Approach to Source Separation," ENST/CNRS/GdR TdSI 46 Rue Barrault, 75634 Paris, France, 1995 International Symposium on Nonlinear Theory and Its Applications (NOLTA '95) Las Vegas, U.S.A., Dec. 10-14, 1995.

Chen, J. et al.: "Speech Detection Using Microphone Array," Electronics Letters Jan. 20, 2000 vol. 36 No. 2, pp. 181-182.

Cho, Y. et al.: "Improved Voice Activity Detection Based on a Smoothed Statistical Likelihood Ratio," Centre for Communication Systems Research, University of Surrey, Guildford, Surrey GU2 7XH, UK, ICASSP, IEEE International Conference on Acoustics, Speech and Signal Processing—Proceedings 2, pp. 737-740.

Choi, S. et al.: "Blind Source Separation and Independent Component Analysis: A Review," Neural Information Processing-Letters and Reviews, vol. 6, No. 1 Jan. 2005.

Comon, P.: "Independent Component Analysis, A New Concept?," Thomson-Sintra Valbonne Cedex, France, Signal Processing 36 (1994) 287-314, (Aug. 24, 1992).

Cruces, S. et al: "Blind Separation of Convolutive Mixtures: a Gauss-Newton Algorithm" Higher-order statistics, 1997, Proceedings of the IEEE Signal Processing Workshop on Banff, Alta., Canada Jul. 21-23, 1997, Los Alamitos, CA IEEE Comput. Soc. US Jul. 21, 1997 pp. 326-330.

De Lathauwer, L. et al.: "Fetal Electrocardiogram Extraction by Source Subspace Separation," Proceedings, IEEE SP/Athos Workshop on Higher-Order Statistics, Jun. 12-14, 1995, Girona, Spain, pp. 134-138. Aug. 1994.

Digital Cellular Telecommunications System (Phase2+); Voice Activity Detector (VAD) for Adaptive Multi-Rate (AMR) Speech Traffic Channels,ETSI Report, DEN/SMG-110694Q7, 2000.

Doukas, N., et al., "Voice Activity Detection Using Source Separation Techniques," Signal Processing Section, Dept of Electrical Engineering, Imperial College, UK, 1997.

Eatwell, G.: "Single-Channel Speech Enhancement" in Noise Reduction in Speech Applications, Davis, G. pp. 155-178, CRC Press, 2002.

Ehlers, F. et al.: "Blind Separation of Convolutive Mixtures and an Application in Automatic Speech Recognition in a Noisy Environment," IEEE Transactions on Signal Processing, vol. 45, No. 10, pp. 2608-2612, Oct. 1997.

ETSI EN 301 708 v 7.1.1 (Dec. 1999); "Digital Cellular Telecommunications System (Phase2+); Voice Activity Detector (VAD) for Adaptive Multi-Rate (AMR) Speech Traffic Channels," GSM 06.94 version 7.1.1 Release 1998.

Figueroa M, et al: "Adaptive Signal Processing in Mixed-Signal VLSI with Anti-Hebbian Learning" Emerging VLSI technologies and architectures, 2006. IEEE Computer Society Annual Symposium on Klarlshuhe, Germany 2-3, Mar. 2006 pp. 133-140.

G. Burel, "Blind separation of sources: A nonlinear neural algorithm," Neural Networks, 5(6):937-947, 1992.

Gabrea, M. et al.: "Two Microphones Speech Enhancement System Based on a Double Fast Recursive Least Squares (DFRLS) Algorithm," Equipe Signal et Image, ENSERB and GDR-134, CNRS, BP 99, 33 402 Talence, France, Lassy-I3S Nice, France, Texas-Instruments, Villenueve-Loubet, France, 1993, pp. II-547.

Girolami, M.: "Noise Reduction and Speech Enhancement via Temporal Anti-Hebbian Learning," Department of Computing and Information Systems, The University of Paisley, Paisley, PA1 2BE, Scotland.

Girolami, M.: "Symmetric Adaptive Maximum Likelihood Estimation for Noise Cancellation and Signal Separation," Electronics Letters 33 (17), pp. 1437-1438, 1997.

Griffiths, L. et al. "An Alternative Approach to Linearly Constrained Adaptive Beamforming." IEEE Transactions on Antennas and Propagation, vol. AP-30(1):27-34. Jan. 1982.

Guerin, A.: "A Two-Sensor Voice Activity Detection and Speech Enhancement based on Coherence with Additional Enhancement of Low Frequencies using Pitch Information," LTSI, Universite de Rennes 1, Bat 22, 7eme etage, campus de Beaulieu, 35042 Rennes Cedex, France.

Gupta, S., et al., "Multiple Microphone Voice Activity Detector," U.S. Appl. No. 11/864,897, filed Sep. 28, 2007.

Haigh, J.A. et al.: "Robust Voice Activity Detection using Cepstral Features," Speech Research Group, Electrical Engineering Department, University College Swansea, SWANSEA, SA2 8PP, UK. p. 321-324.
Hansler, E.: "Adaptive Echo Compensation Applied to the Hands-Free Telephone Problem," Institut fur Netzwerk-und Signaltheorie, Technische Hochschule Darmstadt, Merckstrasse 25, D-6100 Darmstadt, FRG,Proceedings—IEEE International Symposium on Circuits and Systems 1, pp. 279-282, 1990.
Heitkamper, P. et al.: "Adaptive Gain Control for Speech Quality Improvement and Echo Suppression," Proceedings—IEEE International Symposium on Circuits and Systems 1, pp. 455-458, 1993.
Hoyt, J. et al.: "Detection of Human Speech in Structured Noise," Dissertation Abstracts International, B: Sciences and Engineering 56 (1), pp. 237-240, 1994.
Hyvarinen A. et al., "Independent Component Analysis", John Wiley & Sons, NY, 2001.
J. B. Maj, J. Wouters and M. Moonen, "A two-stage adaptive beamformer for noise reduction in hearing aids," International Workshop on Acoustic Echo and Noise Control (IWAENC), pp. 171-174, Sep. 10-13, 2001, Darmstadt, Germany.
Jafari et al, "Adaptive noise cancellation and blind source separation", 4th International Symposium on Independent Component Analysis and Blind Signal Separation (ICA2003), pp. 627-632, Apr. 2003.
John D. Hoyt and Harry Wechsler, "Detection of Human Speech in Structured Noise," Procceedings of ICASSP '94, vol. 11, p. 237-240.
Junqua, J.C. et al.: "A Study of Endpoint Detection Algorithms in Adverse Conditions: Incidence on a DTW and HMM Recognize," in Proc. Eurospeech 91, pp. 1371-1374, 1991.
Jutten, C. et al.: "Blind Separation of Sources, Part I: An Adaptive Algorithm based on Neuromimetic Architecture," Elsevier Science Publishers B.V., Signal Processing 24 (1991) 1-10.
Jutten, C. et al.: "Independent Component Analysis versus Principal Components Analysis," Signal Processing IV: Theo, and Appl. Elsevier Publishers, pp. 643-646, 1988.
Karvanen, et al., ("Temporal decorrelation as pre-processing for linear and post-nonliner ICA") (2004).
Kristjansson Trausti et al., "Voicing features for robust speech detection", In Interspeech- 2005, 369-372.
Kuan-Chieh Yen, et al., "Lattice-ladder decorrelation filters developed for co-channel speech separation", 2001 IEEE International Conference on Acoustics, Speech, and Signal Processing. Proceedings. (ICASSP). Salt Lake City, UT, May 7-11, 2001; [IEEE International Conference on Acoustics, Speech, and Signal Processing (ICASSP)], New York, NY: IEEE, US, vol. 1, May 7, 2001, pp. 637-640, XP010802803, DOI: DOI:10.1109/ICASSP.2001.940912 ISBN: 978-0-7803-7041-8.
Kuan-Chieh Yen, et al., "Lattice-ladder structured adaptive decorrelation filtering for co-channel speech separation", Acoustics, Speech, and Signal Processing, 2000. ICASSP '00. Proceeding S. 2000 IEEE International Conference on Jun. 5-9, 2000, Piscataway, NJ, USA,IEEE, vol. 1,Jun. 5, 2000, pp. 388-391, XP010507350, ISBN: 978-0-7803-6293-2.
Le Bouquin-Jeannes R et al: "Study of a voice activaty detector and its influence on a noise reduction system", Speech Communication, Elseview Science Publishers, Amsterdam, NL, vol. 16, No. 3, Apr. 1, 1995, pp. 245-254.
Lee, Te-Won et. al.: "Combining Time-Delayed Decorrelation and ICA: Towards Solving the Cocktail Party Problem," p. 1249-1252, (1998).
Leong W Y et al: "Blind Multiuser Receiver in Rayleign Fading Channel" Communications Theory Workshop, 2005. Proceedings, 6th Australian Brisbane AUS Feb. 2-4, 2005, Piscataway NJ, IEEE, Feb. 2, 2005 pp. 155-161.
Li, Y. et al: "Methods for the Blind Signal Separation Problem" Neural Networks and Signal Processing, 2003. Proceedings of the 2003 International Conference on Nanjing, China Dec. 14-17, 2003, Piscataway, NJ US IEEE vol. 2, Dec. 14, 2003 pp. 1386-1389.
Low, S.Y. et al: "Spatio-Temporal Processing for Distant Speech Recognition" Acoustics, Speech and Signal Processing, 2004. Proceedings (ICASSP pr) IEEE International Conference on Montreal, Quebec, Canada May 17-21, 2004, Piscataway, NJ, US IEEE, vol. 1, May 17, 2004 pp. 1001-1004.
M. I. Skolnik, Introduction to Radar Systems, McGraw-Hill, New York, 1980.
Macovski A, "Medical Imaging Systems", Chapter 10, pp. 205-211, Prentice-Hall, Englewood Cliffs, New Jersey, 1983.
Makeig, S. et al.: "Independent component analysis of electroencephalographic data," In Advances in Neural Information Processing Systems 8, MIT Press, 1995.
Molgedey, L. et al., "Separation of a mixture of independent signals using time delayed correlations," Physical Review Letters, The American Physical Society, 72(23):3634-3637. 1994.
Mukai et ai, "Removal of residual cross-talk component in blind source separation using LMS filters", pp. 435-444, IEEE 2002.
Mukai et ai, "Removal of residual cross-talk component in blind source separation using time-delayed spectral subtraction", pp. 1789-1792, Proc of ICASSP 2002.
N. Owsley, in Array Signal Processing, S. Haykin ed., Prentice-Hall, Englewood Cliffs, New Jersey, 1985.
Nguyen, L. et al.: "Blind Source Separation for Convolutive Mixtures, Signal Processing," Signal Processing, 45(2):209-229, 1995.
O. L. Frost, "An algorithm for linearly constrained adaptive array processing," Proc. IEEE, vol. 60, No. 8, pp. 926-935, Aug. 1972.
P. M. Peterson, N. I. Durlach, W. M. Rabinowitz and P. M. Zurek, "Multimicrophone adaptive beamforming for interference reduction in hearing aids," Journal of Rehabilitation R&D, vol. 24, Fall 1987.
Parra, L., et al., "Convolutive Blind Separation of Non-Stationary Sources," IEEE Transations on Speech and Audio Processing, vol. 8, No. 3, May 2000. p. 320-327.
Potter M. et al: "Competing ICA techniques in biomedical signal analysis" Electrical and Comptuer Engineering, 2001. Canadian conference on May 13-16, 2001 Piscataway, NJ, IEEE May 13, 2001 pp. 987-992.
R. T. Compton, Jr., "An adaptive array in spread spectrum communication system," Proc. IEEE, vol. 66, pp. 289-298, Mar. 1978.
Rosca, J. et al.: "Multichannel Voice Detection in Adverse Environments," In Proc. EUSIPCO 2002, France, Sep. 2002.
Sattar, F. et al.: "Blind source separation of audio signals using improved ICA method," In Proceedings of the 11th IEEE Signal Processing Workshop on Statistical Signal Processing, pp. 452-455, Singapore, 2001.
S.F. Boll, "Suppression of Acoustic Noise in Speech Using Spectral Subtraction," IEEE Trans. Acoustics, Speech and Signal Processing, 27(2): 112-120, Apr. 1979.
Smaragdis: "Efficient Blind Separation of Convolved Sound Mixtures," Machine Listening Group, MIT Media Lab, Rm. E15-401C, 20 Ames St., Cambridge, MA 02139, IEEE ASSP Workshop on Applications of Signal Processing to Audio and Acoustics, Oct. 1997.
Srinivasan, K. et al.: "Voice Activity Detection for Cellular Networks," Center for Information Processing Research Dept. of Electrical and Computer Engineering, University of California Santa Barbara. p. 85-86.
Tahernezhadi, M. et al.: "Acoustic Echo Cancellation Using Subband Technique for Teleconferencing Applications," Department of Electrical Engineering Northern Illinois University DeKalb, IL 60115; p. 243-247.
Tong, L. et al.: "Indeterminacy and Identifiability of Blind Identification," IEEE transactions on circuits and systems 38 (5), pp. 499-509, 1991.
Torkkola, K.: "Blind Separation of Convolved Sources Based on Information Maximization," Mortorola, Inc., Phoenix Corporate Research Laboratories, 2100 E. Elliot Rd. MD EL508, Tempe AZ 85284, USA, Proceedings of the International Joint Conference on Neura; p. 423-432.
Tucker, R.: "Voice Activity Detection Using a Periodicity Measure," IEE Proceedings, Part I: Communications, Speech and Vision 139 (4), Aug. 1992, pp. 377-380.
Visser, et al., "A Spatio-temporal Speech Enhancement for Robust Speech Recognition in Noisy Environments," Speech Communication, vol. 41, 2003, pp. 393-407.
Vrins F. et al: "Improving independent component analysis performances by variable selection" Neural networks for signal processing, 2003. NNSP'03. 2003 IEEE 13th Workshop on Toulouse, France Sep. 17-19, 2003 Piscataway, NJ, IEEE Sep. 17, 2003 pp. 359-368.
Wang, S. et al.: "Apparatus and Method of Noise and Echo Reduction in Mulitple Microphone Audio Systems," U.S. Appl. No. 11/864,906, filed Sep. 28, 2007.
Widrow, B. et al.: "Adaptive Noise Cancelling: Principles and Applications," Proceedings of the IEEE 63 (12), pp. 1692-1716, 1975.
Wouters, J. et al.: "Speech Intelligibility in Noise Environments with One-and Two-Microphone Hearing Aids," University of Leuven/K. U.Leuven, Lab. Exp. ORL, Kapucijnenvoer 33, B-3000 Leuven, Belgium, Audiology 38 (2), pp. 91-98, 1999.
Wu, B. "Voice Activity Detection Based on Auto-Correlation Function Using Wavelet Transform and Teager Energy Operator," Computational Linguistics and Chinese Language Processing, vol. 11, No. 1, Mar. 2006, pp. 87-100.
Xi, J. et al.: "Blind Separation and Restoration of Signals Mixed in Convolutive Environment," The Communications Research Laboratory, McMaster University Hamilton, Ontario, Canada L8S 4K1, ICASSP, IEEE International Conference on Acous, pp. 1327-1330.
Yasukawa, H. et al.: "An Acoustic Echo Canceller Using Subband Sampling and Decorrelation Methods," IEEE Transactions on Signal Processing, vol. 41, No. 2, Feb. 1993, pp. 926-930.
Yellin, D. et al.: "Criteria for Multichannel Signal Separation," IEEE Transactions on Signal Processing, vol. 42, No. 8, Aug. 1994, pp. 2158-2168.
Zhao, C. et al: "An effective method on blind speech separation in strong noisy environment" VLSI design and video technology, 2005, Proceedings of 2005 IEEE International Workshop on Suzhou, China May 28-30, 2005 Piscataway, NJ USA, IEEE May 28, 2005 pp. 211-214.
Zou, Q. et al.: "A Robust Speech Detection Algorithm in a Microphone Array Teleconferencing System," School of Electrical and Electronics Engineering, Nanyang Avenue, Nanyang Technological University, Singapore 639798, in Proc. ICASSP 2001, pp. 3025-3028.

* cited by examiner

ENHANCED BLIND SOURCE SEPARATION ALGORITHM FOR HIGHLY CORRELATED MIXTURES

BACKGROUND

1. Field

At least one aspect relates to signal processing and, more particularly, processing techniques used in conjunction with blind source separation (BSS) techniques.

2. Background

Some mobile communication devices may employ multiple microphones in an effort to improve the quality of the captured sound and/or audio signals from one or more signal sources. These audio signals are often corrupted with background noise, disturbance, interference, crosstalk and other unwanted signals. Consequently, in order to enhance a desired audio signal, such communication devices typically use advanced signal processing methods to process the audio signals captured by the multiple microphones. This process is often referred to as signal enhancement which provides improved sound/voice quality, reduced background noise, etc., in the desired audio signal while suppressing other irrelevant signals. In speech communications, the desired signal usually is a speech signal and the signal enhancement is referred to as speech enhancement.

Blind source separation (BSS) can be used for signal enhancement. Blind source separation is a technology used to restore independent source signals using multiple independent signal mixtures of the source signals. Each sensor is placed at a different location, and each sensor records a signal, which is a mixture of the source signals. BSS algorithms may be used to separate signals by exploiting the signal differences, which manifest the spatial diversity of the common information that was recorded by both sensors. In speech communication processing, the different sensors may comprise microphones that are placed at different locations relative to the source of the speech that is being recorded.

Beamforming is an alternative technology for signal enhancement. A beamformer performs spatial filtering to separate signals that originate from different spatial locations. Signals from certain directions are amplified while the signals from other directions are attenuated. Thus, beamforming uses directionality of the input signals to enhance the desired signals.

Both blind source separation and beamforming use multiple sensors placed at different locations. Each sensor records or captures a different mixture of the source signals. These mixtures contain the spatial relationship between the source signals and sensors (e.g., microphones). This information is exploited to achieve signal enhancement.

In communication devices having closely spaced microphones, the captured input signals from the microphones may be highly correlated due to the close proximity between the microphones. In this case, traditional noise suppression methods, including blind source separation, may not perform well in separating the desired signals from noise. For example, in a dual microphone system, a BSS algorithm may take the mixed input signals and produce two outputs containing estimates of a desired speech signal and ambient noise. However, it may not be possible to determine which of the two output signal is the desired speech signal and which is the ambient noise after signal separation. This inherent indeterminacy of BSS algorithms causes major performance degradation.

Consequently, a way is needed to improve the performance of blind source separation on communication devices having closely spaced microphones.

SUMMARY

A method for blind source separation of highly correlated signal mixtures is provided. A first input signal associated with a first microphone is received. A second input signal associated with a second microphone is also received. A beamforming technique may be applied to the first and second input signals to provide directionality to the first and second input signals and obtain corresponding first and second output signals. A blind source separation (BSS) technique may be applied to the first output signal and second output signal to generate a first BSS signal and a second BSS signal. At least one of the first and second input signals, the first and second output signals, or the first and second BSS signals may be calibrated.

The beamforming technique may provide directionality to the first and second input signals by applying spatial filters to the first and second input signals. Applying spatial filters to the first and second input signals may amplify sound signals from a first direction while attenuating sound signals from other directions. Applying spatial filter to the first and second input signals may amplify a desired speech signal in the resulting first output signal and attenuates the desired speech signal in the second output signal.

In one example, calibrating at least one of the first and second input signals may comprise applying an adaptive filter to the second input signal, and applying the beamforming technique may include subtracting the first input signal from the second input signal. Applying the beamforming technique may further comprise adding the filtered second input signal to the first input signal.

In another example, calibrating at least one of the first and second input signals may further comprise generating a calibration factor based on a ratio of energy estimates of the first input signal and second input signal, and applying the calibration factor to at least one of either the first input signal or the second input signal.

In yet another example, calibrating at least one of the first and second input signals may further comprise generating a calibration factor based on a ratio of a cross-correlation estimate between the first and second input signals and an energy estimate of the second input signal, and applying the calibration factor to the second input signal.

In yet another example, calibrating at least one of the first and second input signals may further comprise generating a calibration factor based on a ratio of a cross-correlation estimate between the first and second input signals and an energy estimate of the first input signal, and applying the calibration factor to the first input signal.

In yet another example, calibrating at least one of the first and second input signals may further comprise generating a calibration factor based on a cross-correlation between first and second input signals and an energy estimate of the second input signal, multiplying the second input signal by the calibration factor, and dividing the first input signal by the calibration factor.

In one example, applying the beamforming technique to the first and second input signals may further comprise adding the second input signal to the first input signal to obtain a modified first signal, and subtracting the first input signal from the second input signal to obtain a modified second signal. Calibrating at least one of the first and second input signals may further comprise (a) obtaining a first noise floor estimate for the modified first signal, (b) obtaining a second noise floor estimate for the modified second signal, (c) generating a calibration factor based on a ratio of the first noise floor estimate and the second noise floor estimate, (d) applying the calibration factor to the modified second signal, and/or (e) applying an adaptive filter to the modified first signal and subtracting the filtered modified first signal from the modified second signal.

The method for blind source separation of highly correlated signal mixtures may also further comprise (a) obtaining a calibration factor based on the first and second output signals, and/or (b) calibrating at least one of the first and second output signals prior to applying the blind source separation technique to the first and second output signals.

The method for blind source separation of highly correlated signal mixtures may also further comprise (a) obtaining a calibration factor based on the first and second output signals, and/or (b) modifying the operation of the blind source separation technique based on the calibration factor.

The method for blind source separation of highly correlated signal mixtures may also further comprise applying an adaptive filter to the first BSS signal to reduce noise in the first BSS signal, wherein the second BSS signal is used an input to the adaptive filter.

The method for blind source separation of highly correlated signal mixtures may also further comprise (a) calibrating at least one of the first and second input signals by applying at least one of amplitude-based calibration or cross correlation-based calibration, (b) calibrating at least one of the first and second output signals by applying at least one of amplitude-based calibration or cross correlation-based calibration, and/or (c) calibrating at least one of the first and second BSS signals includes applying noise-based calibration.

A communication device is also provided comprising: one or more microphones coupled to one or more calibration modules and a blind source separation module. A first microphone may be configured to obtain a first input signal. A second microphone may be configured to obtain a second input signal. A calibration module configured to perform beamforming on the first and second input signals to obtain corresponding first and second output signals. A blind source separation module configured to perform a blind source separation (BSS) technique to the first output signal and the second output signal to generate a first BSS signal and a second BSS signal. At least one calibration module may be configured to calibrate at least one of the first and second input signals, the first and second output signals, or the first and second BSS signals. The communication device may also include a post-processing module configured to apply an adaptive filter to the first BSS signal to reduce noise in the first BSS signal, wherein the second BSS signal is used as an input to the adaptive filter.

The beamforming module may perform beamforming by applying spatial filters to the first and second input signals, wherein applying a spatial filter to the first and second input signals amplifies sound signals from a first direction while attenuating sound signals from other directions. Applying spatial filters to the first input signal and second input signal may amplify a desired speech signal in the first output signal and may attenuate the desired speech signal in the second output signal.

In one example, in performing beamforming on the first and second input signals, the beamforming module may be further configured to (a) apply an adaptive filter to the second input signal, (b) subtract the first input signal from the second input signal, and (c) add the filtered second input signal to the first input signal.

In one example, in calibrating at least one of the first and second input signals, the calibration module may be further configured to (a) generate a calibration factor based on a ratio of a cross-correlation estimate between the first and second input signals and an energy estimate of the second input signal, and/or (b) apply the calibration factor to the second input signal.

In another example, in calibrating at least one of the first and second input signals, the calibration module may be further configured to (a) generate a calibration factor based on a ratio of a cross-correlation estimate between the first and second input signals and an energy estimate of the first input signal, and/or (b) apply the calibration factor to the first input signal.

In another example, in calibrating at least one of the first and second input signals, the calibration module may be further configured to (a) generate a calibration factor based on a cross-correlation between first and second input signals and an energy estimate of the second input signal, (b) multiply the second input signal by the calibration factor, and/or (c) divide the first input signal by the calibration factor.

In another example, in performing beamforming on the first and second input signals, the beamforming module may be further configured to (a) add the second input signal to the first input signal to obtain a modified first signal, (b) subtract the first input signal from the second input signal to obtain a modified second signal, (c) obtain a first noise floor estimate for the modified first signal, (d) obtain a second noise floor estimate for the modified second signal; and/or the calibration module may be further configured to (e) generate a calibration factor based on a ratio of the first noise floor estimate and the second noise floor estimate, and/or (f) apply the calibration factor to the modified second signal.

In one example, the at least one calibration module may include a first calibration module configured to apply at least one of amplitude-based calibration or cross correlation-based calibration to the first and second input signals.

In another example, the at least one calibration module may include a second calibration module configured to apply at least one of amplitude-based calibration or cross correlation-based calibration to the first and second output signals.

In another example, the at least one calibration module may include a third calibration module configured to apply noise-based calibration to the first and second BSS signals.

Consequently, a communication device is provided comprising (a) means for receiving a first input signal associated with a first microphone and a second input signal associated with a second microphone, (b) means for applying a beamforming technique to the first and second input signals to provide directionality to the first and second input signals and obtain corresponding first and second output signals, (c) means for applying a blind source separation (BSS) technique to the first output signal and second output signal to generate a first BSS signal and a second BSS signal, (d) means for calibrating at least one of the first and second input signals, the first and second output signals, or the first and second BSS signals, (e) means for applying an adaptive filter to the first BSS signal to reduce noise in the first BSS signal, wherein the second BSS signal is used an input to the adaptive filter, (f) means for applying an adaptive filter to the second input signal, (g) means for subtracting the first input signal from the second input signal, (h) means for adding the filtered second input signal to the first input signal, (i) means for obtaining a calibration factor based on the first and second output signals, (j) means for calibrating at least one of the first and second output signals prior to applying blind source separation technique to the first and second output signals, (k) means for obtaining a calibration factor based on the first and second output signals; and/or (l) means for modifying the operation of the blind source separation technique based on the calibration factor.

A circuit for enhancing blind source separation of two or more signals is provided, wherein the circuit is adapted to (a) receive a first input signal associated with a first microphone and a second input signal associated with a second microphone, (b) apply a beamforming technique to the first and second input signals to provide directionality to the first and second input signals and obtain corresponding first and second output signals, (c) apply a blind source separation (BSS) technique to the first output signal and the second output signal to generate a first BSS signal and a second BSS signal, and/or (d) calibrate at least one of the first and second input signals, the first and second output signals, or the first and second BSS signals. The beamforming technique may apply spatial filtering to the first input signal and second input signal and the spatial filter amplifies sound signals from a first direction while attenuating sound signals from other directions. In one example, the circuit is an integrated circuit.

A computer-readable medium is also provided comprising instructions for enhancing blind source separation of two or more signals, which when executed by a processor may cause the processor to (a) obtain a first input signal associated with a first microphone and a second input signal associated with a second microphone, (b) apply a beamforming technique to the first and second input signals to provide directionality to the first and second input signals and obtain corresponding first and second output signals, (c) apply a blind source separation (BSS) technique to the pre-processed first signal and pre-processed second signal to generate a first BSS signal and a second BSS signal; and/or (d) calibrate at least one of the first and second input signals, the first and second output signals, or the first and second BSS signals.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

DETAILED DESCRIPTION

Figure 1:
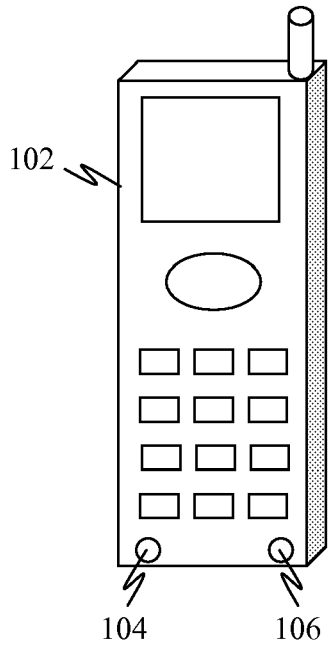
FIG. 1 illustrates an example of a mobile communication device configured to perform signal enhancement.

In the following description, specific details are given to provide a thorough understanding of the configurations. However, it will be understood by one of ordinary skill in the art that the configurations may be practiced without these specific detail. For example, circuits may be shown in block diagrams in order not to obscure the configurations in unnecessary detail. In other instances, well-known circuits, structures and techniques may be shown in detail in order not to obscure the configurations.

Also, it is noted that the configurations may be described as a process that is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a function, a procedure, a subroutine, a subprogram, etc. When a process corresponds to a function, its termination corresponds to a return of the function to the calling function or the main function.

In one or more examples and/or configurations, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above are also be included within the scope of computer-readable media.

Moreover, a storage medium may represent one or more devices for storing data, including read-only memory (ROM), random access memory (RAM), magnetic disk storage mediums, optical storage mediums, flash memory devices and/or other machine readable mediums for storing information.

Furthermore, various configurations may be implemented by hardware, software, firmware, middleware, microcode, and/or any combination thereof. When implemented in software, firmware, middleware or microcode, the program code or code segments to perform the necessary tasks may be stored in a computer-readable medium such as a storage medium or other storage(s). A processor may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

One feature provides a pre-processing stage that preconditions input signals before performing blind source separation, thereby improving the performance of a blind source separation algorithm. First, a calibration and beamforming stage is used to precondition the microphone signals in order to avoid the indeterminacy problem associated with the blind source separation. Blind source separation is then performed on the beamformer output signals to separate the desired speech signal and the ambient noise. This feature assumes that at least two microphones are used and only one signal (from the at least two microphone signals) is a desired signal to be enhanced. For instance, the desired signal may be a speech signal originating from a person using a communication device.

In one example, two microphone signals may be captured on a communication device, where each microphone signal is assumed to contain a mix of a desired speech signal and ambient noise. First, a calibration and beamforming stage is used to precondition the microphone signals. One or more of the preconditioned signals may again be calibrated before and/or after further processing. For example, the preconditioned signals may be calibrated first and then a blind source separation algorithm is used to reconstruct the original signals. The blind source separation algorithm may or may not use a post-processing module to further improve the signal separation performance.

While some examples may use the term "speech signal" for illustration purposes, it should be clear that the various features also apply to all types of "sound signals", which may include voice, audio, music, etc.

One aspect provides for improving blind source separation performance where microphone signal recordings are highly correlated and one source signal is the desired signal. In order to improve the overall performance of the system, non-linear processing methods such as spectral subtraction techniques may be employed after post-processing. The non-linear processing can further help in discriminating the desired signal from noise and other undesirable source signals.

FIG. 1 illustrates an example of a mobile device configured to perform signal enhancement. The mobile device 102 may be a mobile phone, cellular phone, personal assistant, digital audio recorder, communication device, etc., that includes at least two microphones 104 and 106 positioned to capture audio signals from one or more sources. The microphones 104 and 106 may be placed at various locations in the communication device 102. For example, the microphones 104 and 106 may be placed fairly close to each other on the same side of the mobile device 102 so that they capture audio signals from a desired speech source (e.g., user). The distance between the two microphones may vary, for example, from 0.5 centimeters to 10 centimeters. While this example illustrates a two-microphone configuration, other implementations may include additional microphones at different positions.

In speech communications, the desired speech signal is often corrupted with ambient noise including street noise, babble noise, car noise, etc. Not only does such noise reduce the intelligibility of the desired speech, but also makes it uncomfortable for the listeners. Therefore, it is desirable to reduce the ambient noise before transmitting the speech signal to the other party of the communication. Consequently, the mobile device 102 may be configured or adapted to perform signal processing to enhance the quality of the captured sound signals.

Blind source separation (BSS) can be used to reduce the ambient noise. BSS treats the desired speech as one original source and the ambient noise as another source. By forcing the separated signals to be independent of each other, it can separate the desired speech from the ambient noise, i.e. reduce the ambient noise in the speech signal and reduce the desired speech in the ambient noise signal. In general, the desired speech is an independent source. But, the noise can come from several directions. Therefore, the speech reduction in an ambient noise signal can be done well. However, noise reduction in a speech signal may depend on the acoustic environment and can be more challenging than speech reduction in an ambient noise signal. That is, due to the distributed nature of ambient noise, it makes it difficult to represent it as a single source for blind source separation purposes.

As a result of the close positioning between the two microphones 104 and 106, audio signals captured by the two microphones 104 and 106 may be highly correlated and the signal difference may be very small. Consequently, traditional blind source separation processing may not be successful in enhancing the desired audio signal. Therefore, the mobile device 102 may be configured or adapted to, for example, separate desired speech from ambient noise, by implementing a calibration and beamforming stage followed by a blind source separation stage.

Figure 2:
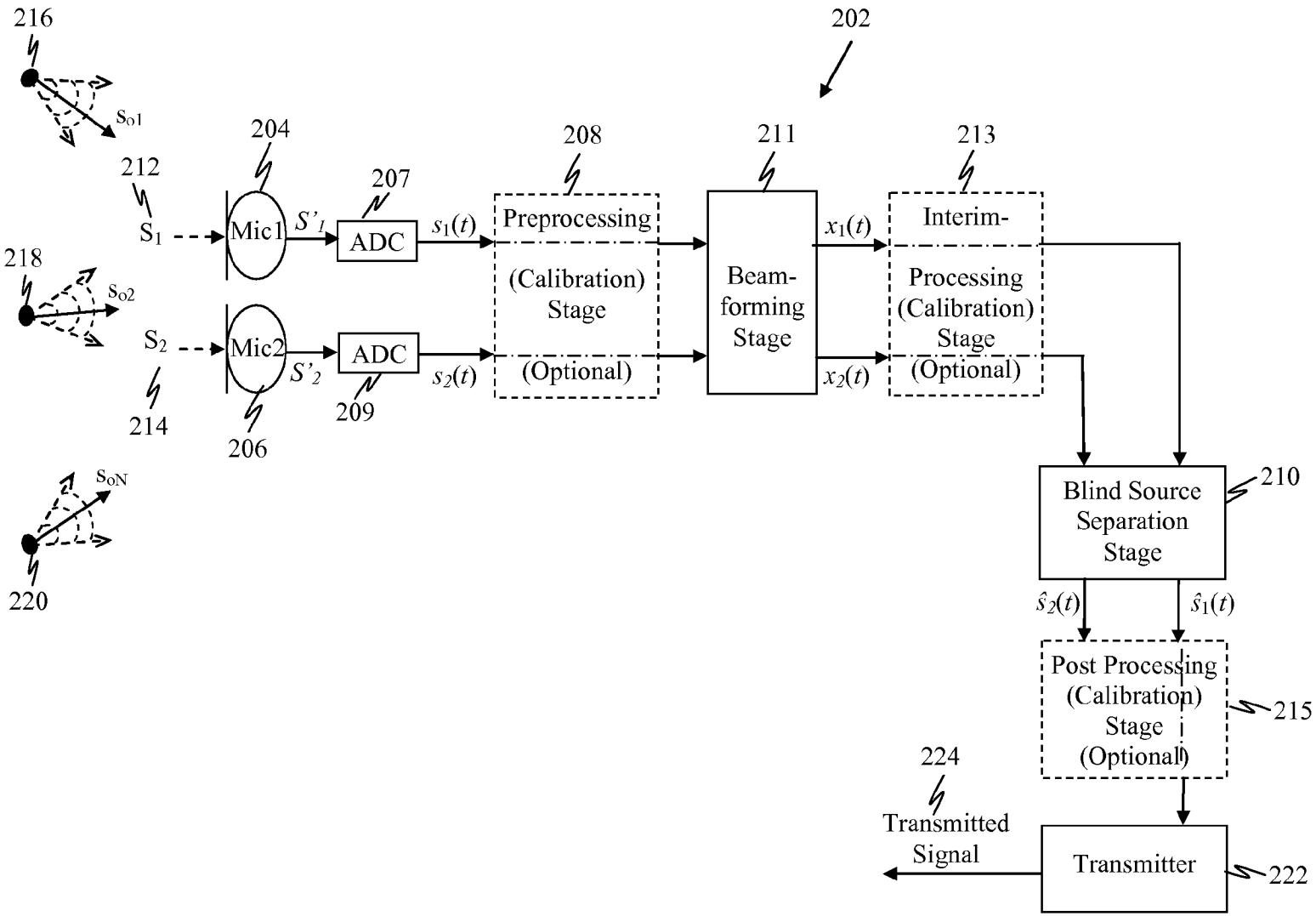
FIG. 2 is a block diagram illustrating components and functions of a mobile communication device configured to perform signal enhancement for closely spaced microphones.

FIG. 2 is a block diagram illustrating components and functions of a mobile device configured to perform signal enhancement for closely spaced microphones. The mobile device 202 may include at least two (unidirectional or omnidirectional) microphones 204 and 206 communicatively coupled to an optional pre-processing (calibration) stage 208, followed by a beamforming stage 211, followed by another optional interim processing (calibration) stage 213, followed by a blind source separation stage 210, and followed by an optional post-processing (e.g., calibration) stage 215. The at least two microphones 204 and 206 may capture mixed acoustic signals $S_1$ 212 and $S_2$ 214 from one or more sound sources 216, 218, and 220. For instance, the acoustic signals $S_1$ 212 and $S_2$ 214 may be mixtures of two or more source sound signals $s_{o1}$, $s_{o2}$ and $s_{oN}$ from the sound sources 216, 218, and 220. The sound sources 216, 218, and 220 may represent one or more users, background or ambient noise, etc. Captured input signals $S'_1$ and $S'_2$ may be sampled by analog-to-digital converters 207 and 209 to provide sampled sound signals $s_1(t)$ and $s_2(t)$.

The acoustic signals $S_1$ 212 and $S_2$ 214 may include desired sound signals and undesired sound signals. The term "sound signal" includes, but is not limited to, audio signals, speech signals, noise signals, and/or other types of signals that may be acoustically transmitted and captured by a microphone.

The pre-processing (calibration) stage 208, beamforming stage 211, and/or interim processing (calibration) stage 213 may be configured or adapted to precondition the captured sampled signals $s_1(t)$ and $s_2(t)$ in order to avoid the indeterminacy problem associated with the blind source separation. That is, while blind source separation algorithms can be used to separate the desired speech signal and ambient noise, these algorithms are not able to determine which output signal is the desired speech and which output signal is the ambient noise after signal separation. This is due to the inherent indeterminacy of all blind source separation algorithms. However, under certain assumptions, some blind source separation algorithms may be able to avoid such indeterminacy. For example, if the desired speech is much stronger in one input channel than in the other, it is likely that the result of blind source separation is deterministic. Yet, where the signals $S'_1$ and $S'_2$ are captured using closely spaced microphones, such an assumption is not valid. Therefore, if a blind source separation algorithm is applied directly to the received signals $S'_1$ and $S'_2$ (or digitized sound signals $s_1(t)$ and $s_2(t)$), the indeterminacy problem is likely to persist. Consequently, the signals $S'_1$ and $S'_2$ may undergo pre-processing (e.g., calibration stages 208 and/or 213 and/or beamforming stage 211) to exploit the directionality of the two or more source sound signals $s_{o1}$, $s_{o2}$ and $s_{oN}$ in order to enhance signal reception from a desired direction.

The beamforming stage 211 may be configured to discriminate useful sound signals by exploiting the directionality of the received sound signals $s_1(t)$ and $s_2(t)$. The beamforming stage 211 may perform spatial filtering by linearly combining the signals captured by the at least two or more microphones 212 and 214. Spatial filtering enhances the reception of sound signals from a desired direction and suppresses the interfering signals coming from other directions. For example, in a two microphone system, the beamforming stage 211 produces a first output $x_1(t)$, and a second output $x_2(t)$. In the first output $x_1(t)$, a desired speech may be enhanced by spatial filtering. In the second output $x_2(t)$, the desired speech may be suppressed and the ambient noise signal may be enhanced.

For example, if the user is first sound source 218, then the original source signal $s_{o2}$ is the desired source sound signal (e.g., desired speech signal). Consequently, in the first output $x_1(t)$, the beamforming stage 211 may perform beamforming to enhance reception from the first sound source 218 while suppressing signals $s_{o1}$ and $s_{oN}$ from other sound sources 216 and 220. In the second output $x_2(t)$, the calibration stages 208 and/or 213 and/or beamforming stage 211 may perform spatial notch filtering to suppress the desired speech signal and enhance the ambient noise signal.

The output signals $x_1(t)$ and $x_2(t)$ may be passed through the blind source separation stage 210 to separate the desired speech signal and the ambient noise. Blind source separation (BSS), also known as Independent Component Analysis (ICA), can be used to restore source signals based on multiple mixtures of these signals. During the signal separation process, only a limited number of signals $x_1(t)$ and $x_2(t)$ which are mixtures of the source sound signals $s_{o1}$, $s_{o2}$ and $s_{oN}$ are available. No prior information regarding the mixing process is available. No direct measurement of the source sound signals is available. Sometimes, a priori statistical information of some or all source signals $s_{o1}$, $s_{o2}$ and $s_{oN}$ may be available. For example, one of the source signals may be Gaussian distributed and another source signal may be uniformly distributed.

The blind source separation stage 210 may provide a first BSS signal $\hat{s}_1(t)$ where noise has been reduced and a second BSS signal $s_2(t)$ in which speech has been reduced. Consequently, the first BSS signal $\hat{s}(t)$ may carry a desired speech signal. The first BSS signal $\hat{s}_1(t)$ may be subsequently transmitted 224 by a transmitter 222.

Figure 3:
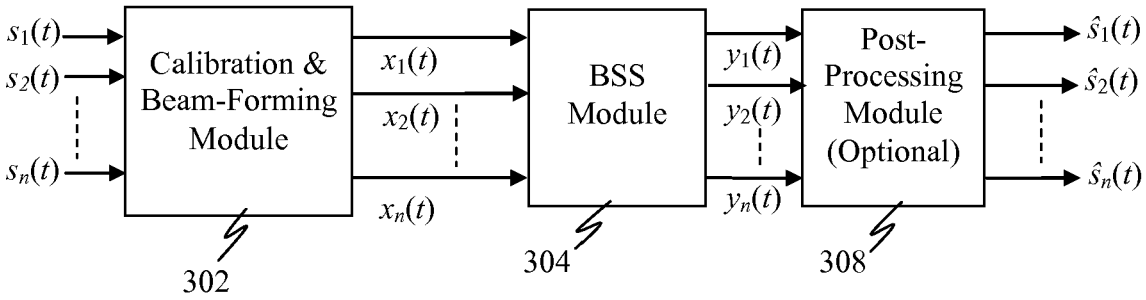
FIG. 3 is a block diagram of one example of sequential beamformer and blind source separation stages according to one example.

FIG. 3 is a block diagram of sequential beamformer and blind source separation stages according to one example. A calibration and beamforming module 302 may be configured to precondition two or more input signals $s_1(t)$, $s_2(t)$ and $s_n(t)$ and provide corresponding output signals $x_1(t)$, $x_2(t)$ and $x_n(t)$ that are then used as inputs to the blind source separation module 304. The two or more input signals $s_1(t)$, $s_2(t)$ and $s_n(t)$ may be correlated or dependent on each other. Signal enhancement through beamforming may not necessitate that the two or more input signals $s_1(t)$, $s_2(t)$ and $s_n(t)$ be modeled as independent random processes. The input signals $s_1(t)$, $s_2(t)$ and $s_n(t)$ may be sampled discrete time signals.

Beamforming Stage—Principle

In beamforming, an input signal $s_1(t)$ may be linearly filtered in both space and time to produce an output signal $x_1(t)$:

$$x_i(t) = \sum_{i=1}^{n} \sum_{p=0}^{k-1} w_i(p) s_i(t-p) \quad \text{(Equation 1)}$$

where k−1 is the number of delay taps in each of n microphone channel inputs. If the desired source signal is represented by $s_{source}(t)$ (e.g., source signal $s_{o2}$ from first sound source 218 in FIG. 2) the beamformer weights $w_i(p)$ may be chosen such that the beamformer output $x_1(t)$ provides an estimate $s_{source}(t)$ of the desired source signal $s_{source}(t)$. This phenomenon is commonly referred to as forming a beam in the direction of the desired source signal $s_{source}(t)$.

Beamformers can be broadly classified into two types: fixed beamformers and adaptive beamformers. Fixed beamformers are data-independent beamformers that employ fixed filter weights to combine the space-time samples obtained from a plurality of microphones. Adaptive beamformers are data-dependent beamformers that employ statistical knowledge of the input signals to derive the filter weights of the beamformer.

Figure 4:
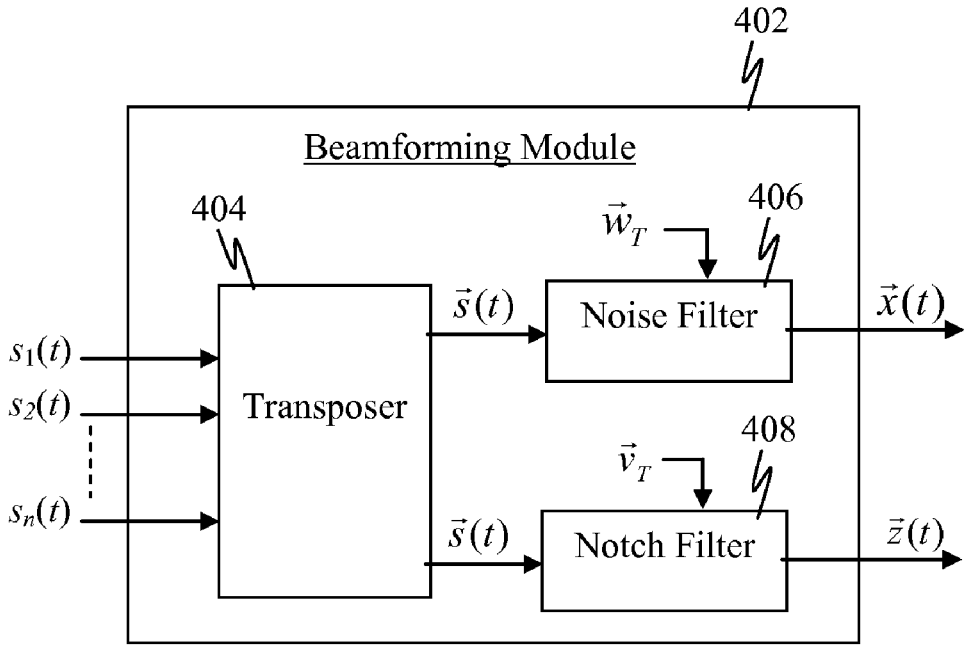
FIG. 4 is a block diagram of an example of a beamforming module configured to perform spatial beamforming.

FIG. 4 is a block diagram of an example of a beamforming module configured to perform spatial beamforming. Spatial-only beamforming is a subset of the space-time beamforming methods (i.e., fixed beamformers). The beamforming module 402 may be configured to receive a plurality of input signals $s_1(t)$, $s_2(t)$, . . . $s_n(t)$ and provide one or more output signals $\vec{x}(t)$ and $\vec{z}(t)$ which are directionally enhanced. A transposer 404 receives the plurality of input signals $s_1(t)$, $s_2(t)$, . . . $s_n(t)$ and performs a transpose operation to obtain a signal vector $\vec{s}(t)=[s_1(t), s_2(t), \ldots s_n(t)]^T$, where the superscript T denotes the transpose operation.

The signal vector $\vec{s}(t)$ may then be filtered by a spatial weight vector to either enhance a signal of interest or suppress an unwanted signal. The spatial weight vector enhances signal capture from a particular direction (e.g., the direction of the beam defined by the weights) while suppressing signals from other directions.

For example, a spatial noise filter 406 may receive the signal vector $\vec{s}(t)$ and filter it by applying a n×1 first spatial weight vector $\vec{w}_T=[w_1, w_2, \ldots w_n]^T$ to produce a first beamformer output $\vec{x}(t)$ such that $$\vec{x}(t)=w_T S(t) \quad \text{(Equation 2)}$$

This beamformer may exploit the spatial information of the input signals $s_1(t), s_2(t), \ldots s_n(t)$ to provide signal enhancement of the desired (sound or speech) signal.

In another example, the beamforming module 402 may include a spatial notch filter 408 that suppresses a desired signal from a second beamformer output $\vec{z}(t)$. In this case, the spatial notch filter 408 suppresses the signals arriving from a desired direction by using a n×1 spatial second weight vector $\vec{v}_T=[v_1, v_2, v_n]^T$ that is orthogonal to the first spatial weight vector $\vec{w}_T$ such that $$\vec{v}_T\vec{w}_T=0 \quad \text{(Equation 3)}$$

The spatial notch filter 408 is applied to the input signal vector $\vec{s}(t)$ to produce the second beamformer output $\vec{z}(t)$ where the desired signal is minimized.

$$\vec{z}(t)=\vec{v}_T\vec{s}(t) \quad \text{(Equation 4)}$$

The second beamformer output $\vec{z}(t)$ may provide an estimate of the background noise in the captured input signal. In this manner, the second beamformer output $\vec{z}(t)$ may be from an orthogonal direction to the first beamformer output $\vec{x}(t)$.

The spatial discrimination capability provided by the beamforming module 402 may depend on the spacing of the two or more microphones used relative to the wavelength of the propagating signal. The directionality/spatial discrimination of the beamforming module 402 typically improves as the relative distance between the two or more microphones increases. Hence, for closely spaced microphones, the directionality of the beamforming module 402 may be poorer and further temporal post-processing may be performed to improve the signal enhancement or suppression. However, despite such performance limitations of the beamforming module 402, it may nevertheless provide sufficient spatial discrimination in the output signals $\vec{x}(t)$ and $\vec{z}(t)$ to improve performance of a subsequent blind source separation stage. The output signals $\vec{x}(t)$ and $\vec{z}(t)$ in the beamforming module 402 of FIG. 4 may be output signals $x_1(t)$ and $x_2(t)$ from the beamforming module 302 of FIG. 3 or beamforming stage 211 of FIG. 2.

The beamforming module 302 may implement various additional pre-processing operations on the input signals. In some instances, there may be a significant difference in sound levels (e.g., power levels, energy levels) between signals captured by two microphones. Such difference in sound levels may make it difficult to perform beamforming. Therefore, one aspect may provide for calibrating input signals as part of performing beamforming. Such calibration of input signals may be performed before and/or after the beamforming stage (e.g., FIG. 2, calibrations stages 208 and 213). In various implementations, the pre-blind source separation calibration stage(s) may be amplitude-based and/or cross correlation-based calibration. That is, in amplitude-based calibration the amplitude of the speech or sound input signals are calibrated by comparing them against each other. In cross-correlation-based calibration the cross-correlation of the speech or sound signals are calibrated by comparing them against each other.

Example 1

Calibration and Beamforming

Figure 5:
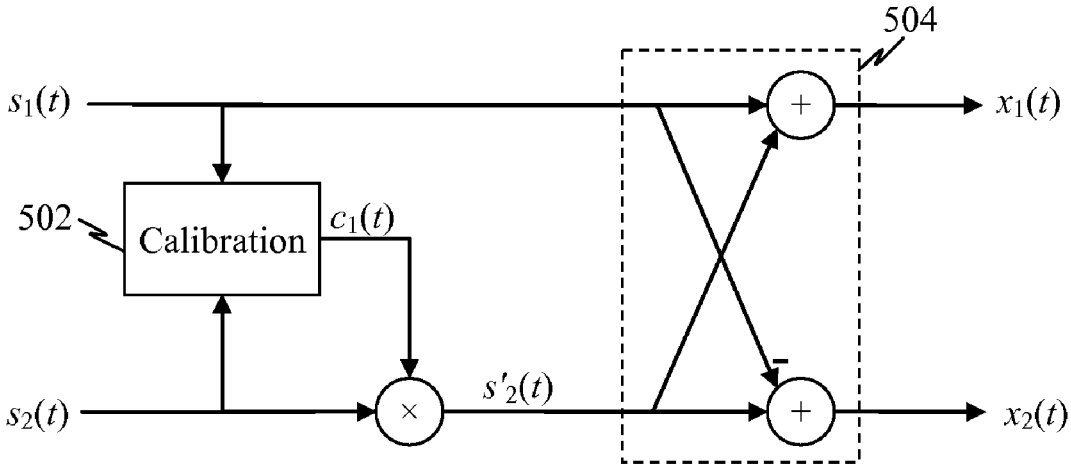
FIG. 5 is a block diagram illustrating a first example of calibration and beamforming using input signals from two or more microphones.

FIG. 5 is a block diagram illustrating a first example of calibration and beamforming using input signals from two or more microphones. In this implementation, a second input signal $s_2(t)$ may be calibrated by a calibration module 502 before beamforming is performed by a beamforming module 504. The calibration process can be formulated as $s'_2(t)=c_1(t)\cdot s_2(t)$. The calibration factor $c_1(t)$ may scale the second input $s_2(t)$ such that sound level of the desired speech in $S'_2(t)$ is close to that of the first input signal $s_1(t)$.

Figure 6:
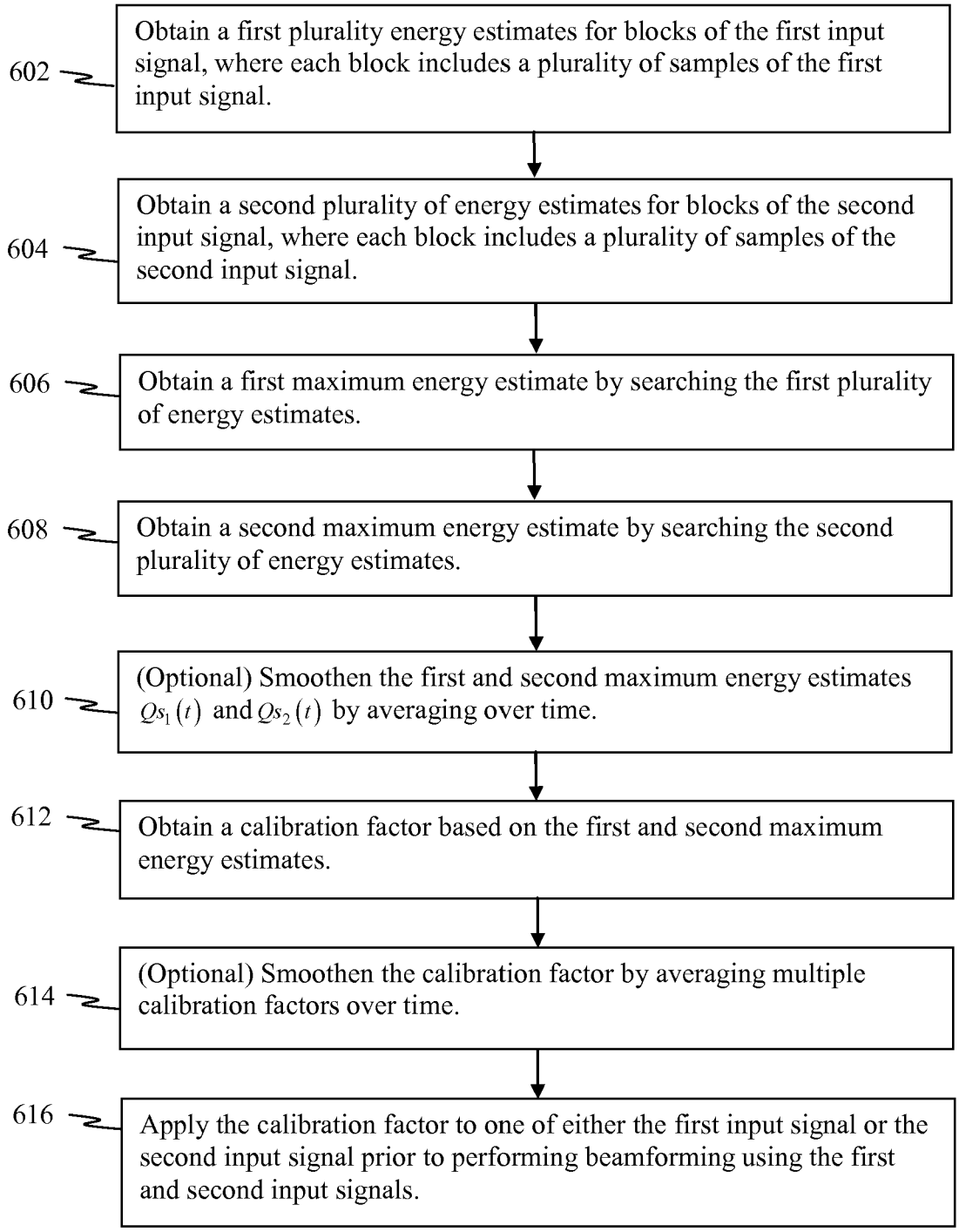
FIG. 6 is a flow diagram illustrating a first method for obtaining a calibration factor that can be applied to calibrate two microphone signals prior to implementing beamforming based on the two microphone signals.
Figure 7:
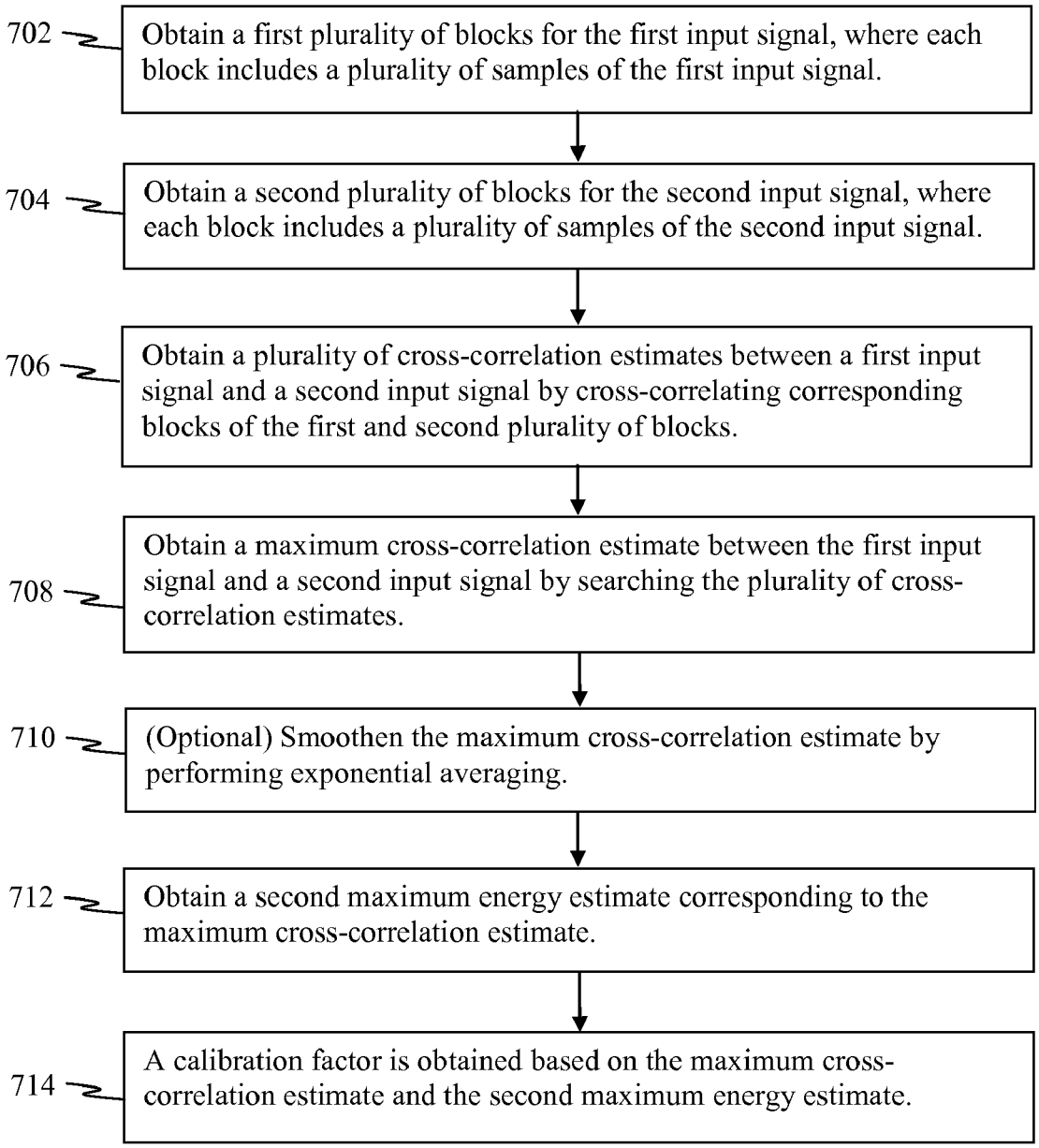
FIG. 7 is a flow diagram illustrating a second method for obtaining a calibration factor that can be applied to calibrate two microphone signals prior to implementing beamforming based on the two microphone signals.

Various methods may be used in obtaining the calibration factor $c_1(t)$ to calibrate two input signals $s_1(t)$ and $s_2(t)$ in FIG. 5. FIGS. 6 and 7 illustrate two methods that may be used in obtaining the calibration factor $c_1(t)$.

FIG. 6 is a flow diagram illustrating a first method for obtaining a calibration factor that can be applied to calibrate two microphone signals prior to implementing beamforming based on the two microphone signals. A calibration factor $c_1(t)$ may be obtained from short term speech energy estimates of a first and a second input signals $s_1(t)$ and $s_2(t)$, respectively. A first plurality energy terms or estimates $Ps_1(t)_{(1 \ldots k)}$ may be obtained for blocks of the first input signal $s_1(t)$, where each block includes a plurality of samples of the first input signal $s_1(t)$ 602. Similarly, a second plurality of energy terms or estimates $Ps_2(t)_{(1 \ldots k)}$ may be obtained for blocks of the second input signal $s_2(t)$, where each block may include a plurality of samples of the second input signal $s_2(t)$ 604. For example, the energy estimates $Ps_1(t)$ and $Ps_2(t)$ can be calculated from a block of signal samples using the following equations:

$$Ps_1(t)=\sum_{n=0}^{N-1} s_1^2(t-n) \quad \text{(Equations 5 \& 6)}$$

$$Ps_2(t)=\sum_{n=0}^{N-1} s_2^2(t-n)$$

A first maximum energy estimate $Qs_1(t)$ may be obtained by searching the first plurality of energy terms or estimates $Ps_1(t)_{(1 \ldots k)}$ 606, for example, over energy terms for fifty (50) or one hundred (100) blocks. Similarly, second maximum energy estimate $Qs_2(t)$ may be obtained by searching the second plurality of energy terms or estimates $Ps_2(t)_{(1 \ldots k)}$ 608. Computing these maximum energy estimates over several blocks may be a simpler way of calculating the energy of desired speech without implementing a speech activity detector. In one example, the first maximum energy estimate $Qs_1(t)$ may be calculated using the following equation:

$$Qs_1(t)=\max_{50\ blocks} Ps_1(t) \quad \text{(Equations 7 \& 8)}$$

$$t_{max}=\max_{t(50\ blocks)} Ps_1(t)$$

where $t_{max}$ corresponds to the signal block identified with the maximum energy estimate $Qs_1(t)$. The second maximum energy estimate $Qs_2(t)$ may be similarly calculated. Or alternately, the second maximum energy estimate $Qs_2(t)$ may also be calculated as the energy estimate of the second microphone signal computed at the $t_{max}$ signal block: $Qs_2(t)=Ps_2(t_{max})$ The first and second maximum energy estimates $Qs_1(t)$ and $Qs_2(t)$ may also be averaged (smoothed) over time 610 before computing the calibration factor $c_1(t)$. For example, exponential averaging can be performed as follows:

$$\tilde{Q}s_1(t)=\alpha\tilde{Q}s(t-1)+(1-\alpha)Qs_1(t)$$

$$Qs_2(t)=\alpha\tilde{Q}s_2(t-1)+(1-\alpha)Qs_2(t)0<\alpha<1 \quad \text{(Equations 9 \& 10)}$$

The calibration factor $c_1(t)$ may be obtained based on the first and second maximum energy estimates $Qs_1(t)$ and $Qs_2(t)$ 612. In one example, the calibration factor may be obtained using the following equation:

$$c_1(t) = \sqrt{\tilde{Q}s_1(t)/\tilde{Q}s_2(t)} \quad \text{(Equation 11)}$$

The calibration factor $c_1(t)$ can also be further smoothened over time 614 to filter out any transients in the calibration estimates. The calibration factor $c_1(t)$ may then be applied to the second input signal $s_2(t)$ prior to performing beamforming using the first and second input signals $s_1(t)$ and $s_2(t)$ 616. Alternately, the inverse of the calibration factor $c_1(t)$ may be computed and smoothened over time and then applied to the first input signal $s_1(t)$ prior to performing beamforming using the first and second input signals $s_1(t)$ and $S_2(t)$ 616.

FIG. 7 is a flow diagram illustrating a second method for obtaining a calibration factor that can be applied to calibrate two microphone signals prior to implementing beamforming based on the two microphone signals. In this second method, the cross-correlation between the two input signals $s_1(t)$ and $s_2(t)$ may be used instead of the short term energy estimates $Ps_1(t)$ and $Ps_n(t)$. If the two microphones are located close to each other, the desired speech (sound) signal in the two input signals can be expected to be highly correlated with each other. Therefore, a cross-correlation estimate $Ps_{12}(t)$ between the first and second input signals $s_1(t)$ and $s_2(t)$ may be obtained to calibrate the sound level in the second microphone signal $s_2(t)$. For instance, a first plurality of blocks for the first input signal $s_1(t)$ may be obtained, where each block includes a plurality of samples of the first input signal $s_1(t)$ 702. Similarly, a second plurality of blocks for the second input signal $s_2(t)$ may be obtained, where each block includes a plurality of samples of the second input signal $s_2(t)$ 704. A plurality cross-correlation estimates $Ps_{12}(t)_{(1 \ldots k)}$ between a first input signal $s_1(t)$ and a second input signal $s_2(t)$ may be obtained by cross-correlating corresponding blocks of the first and second plurality of blocks 706. For example, a cross-correlation estimate $Ps_{12}(t)$ can be computed using the following equation:

$$Ps_{12}(t) = \sum_{n=0}^{N-1} s_1(t-n)s_2(t-n) \quad \text{(Equation 12)}$$

A maximum cross-correlation estimate $Qs_{12}(t)$ between the first input signal $s_1(t)$ and a second input signal $s_2(t)$ may be obtained by searching the plurality of cross-correlation estimates $Ps_{12}(t)_{(1 \ldots k)}$ 708. For instance, the maximum cross-correlation estimate $Qs_{12}(t)$ can be obtained by using $$Qs_{12}(t) = \max_{50\ blocks} Ps_{12}(t) \quad \text{(Equations 13 \& 14)}$$

$$t_{max} = \max_{t(50\ blocks)} Ps_{12}(t)$$

The second maximum energy estimate $Qs_2(t)$ may be calculated as the maximum second microphone energy estimate using equations (6) and (7). 712. Or alternately, the second maximum energy estimate may also be calculated as the energy estimate of the second microphone signal computed at the $t_{max}$ signal block: $Qs_2(t)=Ps_2(t_{max})$. The maximum cross-correlation estimate $Qs_{12}(t)$ and the maximum energy estimate $Qs_2(t)$ may be smoothened by performing exponential averaging 710, for example, using following equation:

$$Qs_{12}(t)=\alpha Qs_{12}(t-1)+(1-\alpha)Ps_{12}(t)$$

$$Qs_2(t)=\alpha Qs_2(t-1)+(1-\alpha)Qs_2(t)0<a<1 \quad \text{(Equations 15 \& 16)}$$

A calibration factor $c_1(t)$ is obtained based on the maximum cross-correlation estimate $Qs_{12}(t)$ and the second maximum energy estimate $Qs_2(t)$ 714, for example, using following equation:

$$c_1(t)=Qs_{12}(t)/\tilde{Q}s_2(t) \quad \text{(Equations 17)}$$

Consequently, the calibration factor $c_1(t)$ may be generated based on a ratio of a cross-correlation estimate between the first and second input signals $s_1(t)$ and $s_2(t)$ and an energy estimate of the second input signal $s_2(t)$. The calibration factor $c_1(t)$ may then be applied to the second input signal $s_2(t)$ to obtain a calibrated second input signal $s'_2(t)$ may then be added to the first input signal $s_1(t)$.

Referring again to FIG. 5, the resulting first and second output signals $x_1(t)$ and $x_2(t)$ after calibration can added or subtracted by the beamforming module 504, such that:

$$\begin{cases} x_1(t) = s_1(t) + s'_2(t) \\ x_2(t) = s'_2(t) - s_1(t) \end{cases} \quad \text{(Equations 18 \& 19)}$$

The first output signal $x_1(t)$ can be considered as the output of a fixed spatial beamformer which forms a beam towards the desired sound source. The second output signal $x_2(t)$ can be considered as the output of a fixed notch beamformer that suppresses the desired speech signal by forming a null in the desired sound source direction.

In another example, the calibration factor $c_1(t)$ may be generated based on a ratio of a cross-correlation estimate between the first and second input signals $s_1(t)$ and $s_2(t)$ and an energy estimate of the first input signal $s_1(t)$. The calibration factor $c_1(t)$ is then applied to the first input signal $s_1(t)$. The calibrated first input signal may then be subtracted from the second input signal $s_2(t)$.

Example 2

Calibration and Beamforming

Figure 8:
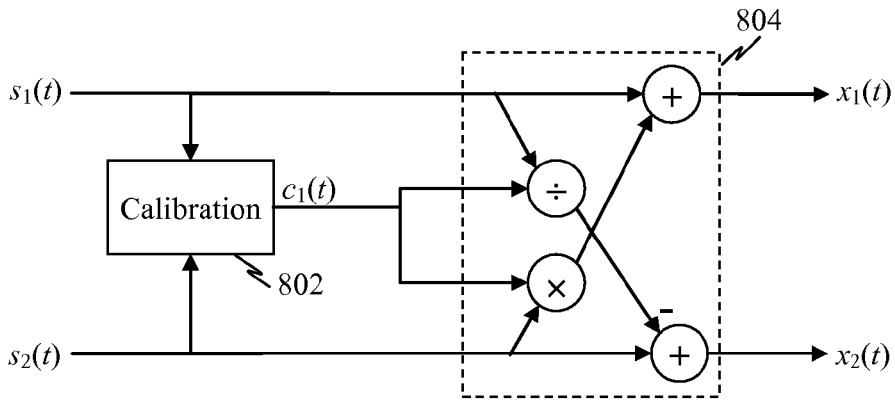
FIG. 8 is a block diagram illustrating a second example of calibration and beamforming using input signals from two or more microphones.

FIG. 8 is a block diagram illustrating a second example of calibration and beamforming using input signals from two or more microphones. In this implementation, instead of using a calibration factor to scale the second input signal $s_2(t)$ (as in FIG. 5), the calibration factor $c_1(t)$ may be used to adjust both the input signals $s_1(t)$ and $s_2(t)$ before beamforming. The calibration factor $c_1(t)$ for this implementation may be obtained by a calibration module 802, for example, using the same procedures described in FIGS. 6 and 7. Once the calibration factor $c_1(t)$ is obtained, a beamforming module 804 may generate output signals $x_1(t)$ and $x_2(t)$ such that:

$$\begin{cases} x_1(t) = s_1(t) + c_1(t)s_2(t) \\ x_2(t) = s_2(t) - s_1(t)/c_1(t) \end{cases} \quad \text{(Equations 20 \& 21)}$$

where the first output signal $x_1(t)$ can be considered as the output of a fixed spatial beamformer which forms a beam towards a desired sound source. The second output signal $x_2(t)$ can be considered as the output of a fixed notch beamformer that suppresses the desired speech signal by forming a null in the desired sound source direction.

In one example, the calibration factor $c_1(t)$ may be based on a cross-correlation between the first and second input signals and an energy estimate of the second input signal $s_2(t)$. The second input signal $s_2(t)$ may be multiplied by the calibration factor $c_1(t)$ and added to the first input signal $s_1(t)$. The first input signal $s_1(t)$ may be divided by the calibration factor $c_1(t)$ and subtracted from the first input signal $s_1(t)$.

Example 3

Calibration and Beamforming

Figure 9:
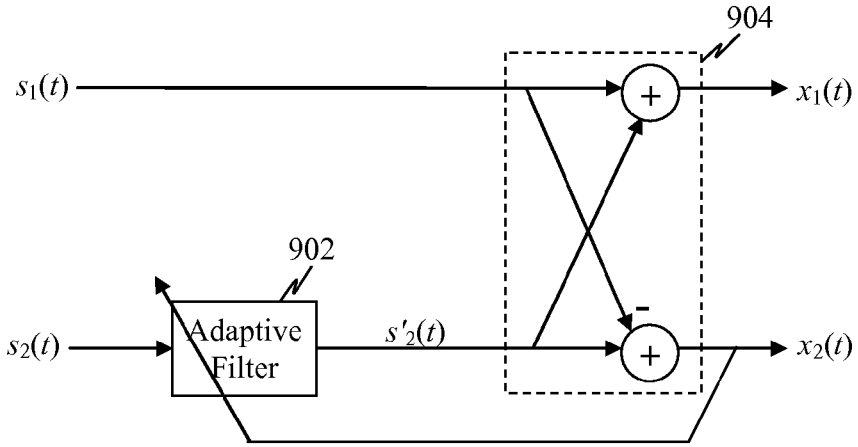
FIG. 9 is a block diagram illustrating a third example of calibration and beamforming using input signals from two or more microphones.

FIG. 9 is a block diagram illustrating a third example of calibration and beamforming using input signals from two or more microphones. This implementation generalizes the calibration procedure illustrated in FIGS. 5 and 8 to include an adaptive filter 902. A second microphone signal $s_2(t)$ may be used as the input signal for the adaptive filter 902 and a first microphone signal $s_1(t)$ may be used as a reference signal. The adaptive filter 902 may include weights $w_t=[w_t(0)\ w_t(1) \ldots w_t(N-1)]^T$, where N is the length of the adaptive filter 902. The adaptive filtering process can be represented as $$s_2'(t) = s_1(t) - \sum_{i=0}^{N-1} w_t(i) * s_2(t-i) \quad \text{(Equation 22)}$$

The adaptive filter 902 may be adapted using various types of adaptive filtering algorithms. For example, the adaptive filter 902 can be adapted using the Least-Mean-Square (LMS) type algorithm as follows, $$w_t = w_{t-1} + 2\mu x_2(t) s_2(t) \quad \text{(Equation 23)}$$

where $\mu$ is the step size and $s_2(t)$ is the second input signal vector as illustrated in Equation 24:

$$\bar{s}_2(t) = \begin{bmatrix} s_2(t) \\ s_2(t-1) \\ M \\ s_2(t-N+1) \end{bmatrix} \quad \text{(Equation 24)}$$

The adaptive filter 902 may act as an adaptive beamformer and suppress the desired speech in the second microphone input signal $s_2(t)$. If the adaptive filter length is chosen to be one (1), this method becomes equivalent to the calibration approach described in FIG. 7 where the cross-correlation between the two microphone signals may be used to calibrate the second microphone signal.

A beamforming module 904 processes the first microphone signal $s_1(t)$ and the filtered second microphone signal $s'_2(t)$ to obtain a first and second output signals $x_1(t)$ and $x_2(t)$. The second output signal $x_2(t)$ can be considered as the output of a fixed notch beamformer that suppresses the desired speech signal by forming a null in the desired sound (speech) source direction. The first output signal $x_1(t)$ may be obtained by adding the filtered second microphone signal $s'_2(t)$ to the first microphone signal $s_1(t)$ to obtain a beamformed output of the desired sound source signal, a follows:

$$x_1(t) = s_1(t) + s'_2(t) \quad \text{(Equation 25)}$$

The first output signal $x_1(t)$ may be scaled by a factor of 0.5 to keep the speech level in $x_1(t)$ the same as that in $s_1(t)$. Thus, the first output signal $x_1(t)$ contains both the desired speech (sound) signal and the ambient noise, while a second output signal $x_2(t)$ contains mostly ambient noise and some of the desired speech (sound) signal.

Example 4

Calibration and Beamforming

Figure 10:
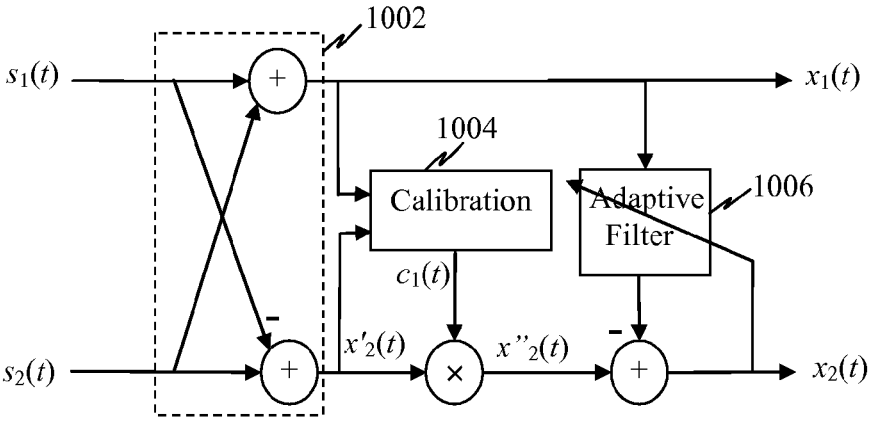
FIG. 10 is a block diagram illustrating a fourth example of calibration and beamforming using input signals from two or more microphones.

FIG. 10 is a block diagram illustrating a fourth example of calibration and beamforming using input signals from two or more microphones. In this implementation, no calibration is performed before beamforming. Instead, beamforming is performed first by a beamforming module 1002 that combines the two input signals $s_1(t)$ and $s_2(t)$ as:

$$\begin{cases} x_1(t) = s_1(t) + s_2(t) \\ x_2'(t) = s_2(t) - s_1(t) \end{cases} \quad \text{(Equation 26)}$$

After beamforming, the noise level in the beamformer second output signal $x'_2(t)$ may be much lower than that in the first output signal $x_1(t)$. Therefore, a calibration module 1004 may be used to scale the noise level in the beamformer second output signal $x'_2(t)$. The calibration module 1004 may obtain a calibration factor $c_1(t)$ from the noise floor estimates of the beamformer outputs signals $x_1(t)$ and $x'_2(t)$. The short term energy estimates of output signals $x_1(t)$ and $x'_2(t)$ may be denoted by $Px_1(t)$ and $Px_2(t)$, respectively and the corresponding noise floor estimates may be denoted by $Nx_1(t)$ and $Nx_2(t)$. The noise floor estimates $Nx_1(t)$ and $Nx_2(t)$ may be obtained by finding the minima of the short term energy estimates $Px_1(t)$ and $Nx_2(t)$ over several consecutive blocks, say 50 or 100 blocks of input signal samples. For example, the noise floor estimates $Nx_1(t)$ and $Nx'_2(t)$ can be computed using Equations 27 and 28, respectively:

$$Nx_1(t) = \min_{50\ \text{blocks}} (Px_1(t)) \quad \text{(Equations 27 \& 28)}$$

$$Nx_2'(t) = \min_{50\ \text{blocks}} (Px_2'(t))$$

The noise floor estimates $Nx_1(t)$ and $Nx_2(t)$. may be averaged over time to smooth out discontinuities and the calibration factor $c_1(t)$ may be computed as the ratio of the smoothened noise floor estimates such that $$c_1(t) = \frac{N'x_1(t)}{N'x_2'(t)} \quad \text{(Equation 29)}$$

Where $N'x_1(t)$ and $Nx_2(t)$ are the smoothened noise floor estimates of $x_1(t)$ and $x'_2(t)$. The beamformed second output signal $x'_2(t)$ is scaled by the calibration factor $c_1(t)$ to obtain a final noise reference output signal $x_2'(t)$, such that:

$$x_2''(t)=c_1(t)x_2'(t) \quad \text{(Equation 30)}$$

After the calibration, an adaptive filter 1006 may be applied. The adaptive filter 1006 may be implemented as described with reference to adaptive filter 902 (FIG. 9). The first output signal $x_1(t)$ may be used as the input signal to the adaptive filter 1006 and the calibrated output signal $x''_2(t)$ may be used as the reference signal. The adaptive filter 1006 may suppress the desired speech signal in the calibrated beamformer output signal $x''_2(t)$. Thus, the first output signal $x_1(t)$ may contain both the desired speech and the ambient noise, while the second output signal $x_2(t)$ may contain mostly ambient noise and some desired speech. Consequently, the two output signals $x_1(t)$ and $x_2(t)$ may meet the assumption mentioned earlier for avoiding the indeterminacy of BSS, namely, that they are not highly correlated.

In the various examples illustrated in FIGS. 5-10, the calibration stage(s) may implement amplitude-based and/or cross correlation-based calibration on the speech or sound sign.

Blind Source Separation Stage

Referring again to FIG. 3, output signals $x_1(t)$, $x_2(t)$ and $x_1(t)$ from the beamforming module 302 may pass to the blind source separation module 304. The blind source separation module 304 may process the beamformer output signals $x_1(t)$, $x_2(t)$ and $x_1(t)$. The signals $x_1(t)$, $x_2(t)$ and $x_1(t)$ may be mixtures of source signals. The blind source separation module 304 separates the input mixtures and produces estimates $y_1(t)$, $y_2(t)$ and $y_n(t)$ of the source signals. For example, in the case of dual-microphone noise reduction where just one source signal may be the desired signal, the blind source separation module 304 may decorrelate a desired speech signal (e.g., first source sound signal $s_{o2}$ in FIG. 2) and the ambient noise (e.g., noise $s_{o1}$ and $s_{oN}$ in FIG. 2).

Blind Source Separation—Principles

In blind source separation or decorrelation, input signals are treated as independent random processes. The assumption used to blindly separate signals is that all random processes are statistically independent of each other, i.e. the joint probability distribution P of all random processes $S_1$, $S_2$ and $S_m$ is the product of all individual random processes. This assumption can be formulated as $$P_{s1,\ldots,s_m}(s_1,\ldots,s_m)=P_{s_1}(s_1)\ldots P_{s_m}(s_m) \quad \text{(Equation 31)}$$

where $P_{s_1,\ldots,s_m}(s_1,\ldots,s_m)$ is joint distribution of all random processes $s_1,\ldots,s_m$ and $P_{s_1}(s_j)$ is the distribution of the jth random process $S_j$.

In general, blind source separation may be classified into two categories, instantaneous BSS and convolutive BSS. Instantaneous BSS refers to mixed input signals $\hat{s}(t)$ that can be modeled as instantaneous matrix mixing, which is formulated as $$x(t)=As(t) \quad \text{(Equation 32)}$$

where s(t) is an m×1 vector, x(t) is an n×1 vector, A is an n×m scalar matrix. In the separation process, an m×n scalar matrix B is calculated and used to reconstruct a signal $\hat{s}(t)=Bx(t)=BAs(t)$ such that $\hat{s}(t)$ resembles s(t) up to an arbitrary permutation and an arbitrary scaling. That is, matrix BA can be decomposed into PD, where matrix P is a permutation matrix and matrix D is a diagonal matrix. A permutation matrix is a matrix derived by permuting the identity matrix of the same dimension. A diagonal matrix is a matrix that only has non-zero entries on its diagonal. Note that the diagonal matrix D does not have to be an identity matrix. If all m sound sources are independent of one another, there should not be any zero entry on the diagonal of the matrix D. In general, $n \geqq m$ is desirable for complete signal separation, i.e., the number of microphones n is greater than or equal to the number of sound sources m.

In practice, few problems can be modeled using instantaneous mixing. Signals typically travel through non-ideal channels before being captured by microphones or audio sensors. Hence, convolutive BSS may be used to better model the input signals.

Figure 11:
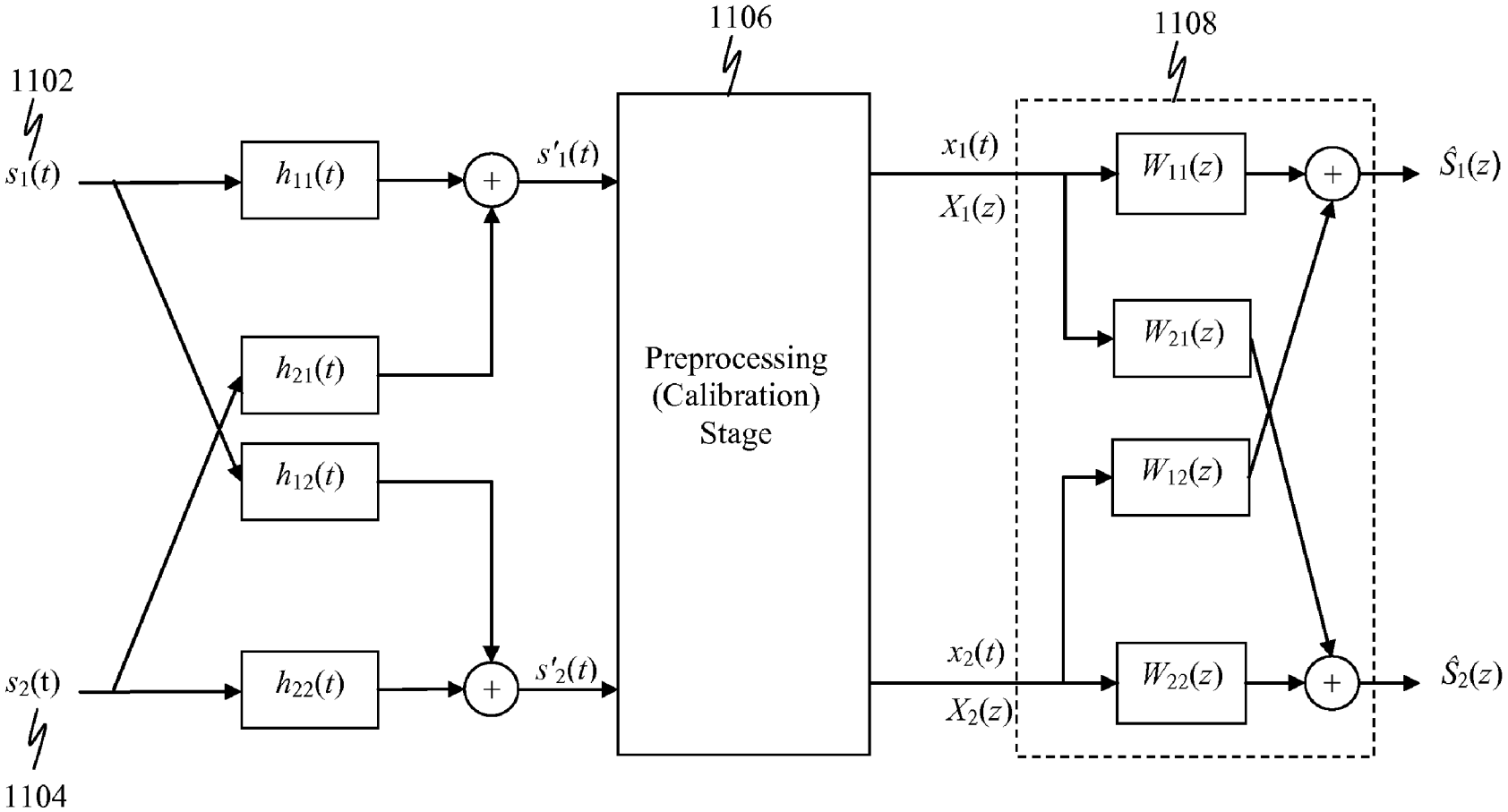
FIG. 11 is a block diagram illustrating the operation of convolutive blind source separation to restore a source signal from a plurality of mixed input signals.

FIG. 11 is a block diagram illustrating the operation of convolutive blind source separation to restore a source signal from a plurality of mixed input signals. Source signals $s_1(t)$ 1102 and $s_2(t)$ 1104 may pass through a channel where they are mixed. The mixed signals may be captured by microphones as input signals $s'_1(t)$ and $s'_2(t)$ and passed through a preprocessing stage 1106 where they may be preconditioned (e.g., beamforming) prior to passing a blind source separation stage 1108 as signals $x_1(t)$ and $x_2(t)$.

Input signals $s'_1(t)$ and $s'_2(t)$ may be modeled based on the original source signals $s_1(t)$ 1102 and $s_2(t)$ 1104 and channel transfer functions from sound sources to one or more microphones and the mixture of the input. For instance, convolutive BSS may used where mixed input signals s'(t) can be modeled as $$s_i'(t) = \sum_{j=1}^{m} h_{ij}(t) \otimes s_j(t) \quad i = 1, \ldots, n \quad \text{(Equation 33)}$$

where $s_j(t)$ is the source signal originating from the jth sound source, $s_i'(t)$ is the input signal captured by the ith microphone, $h_{ij}(t)$ is the transfer function between the jth sound source and the ith microphones, and symbol $\otimes$ denotes a convolution operation. Meanwhile, for convolutive BSS, complete separation can be achieved if $n \geqq m$, i.e., the number of microphones n is greater than or equal to the number of sound sources m.

In FIG. 11, the transfer functions $h_{11}(t)$ and $h_{12}(t)$ represent the channel transfer functions from a first signal source to the first and second microphones. Similarly, transfer functions $h_{21}(t)$ and $h_{22}(t)$ represent the channel transfer functions from a second signal source to the first and second microphones. The signals pass through the preprocessing stage 1106 (beamforming) prior to passing to the blind source separation stage 1108. The mixed input signals $s'_1(t)$ and $s'_2(t)$ (as captured by the first and second microphones) then pass through the beamforming preprocessing stage 1106 to obtain signals $x_1(t)$ and $x_2(t)$.

Blind source separation may then be applied to the mixed signals $x_1(t)$ to separate or extract estimates $s_j(t)$ corresponding to the original source signals $s_j(t)$. To accomplish this, a set of filters $W_{ji}(z)$ may be used at the blind source separation stage 1108 to reverse the signal mixing. For purposes of convenience, the blind source separation is represented in the Z transform domain. In this example, $X_1(z)$ is the Z domain version of $x_1(t)$ and $X_2(z)$ is the Z domain version of $x_2(t)$.

The signals $X_1(z)$ and $X_2(z)$ are modified according to filters $W_{ji}(z)$ to obtain an estimate $\hat{S}(z)$ of the original source signal S(z) (which is equivalent to s(t) in the time domain) such that $$\hat{S}_j(z) = \sum_{i=1}^{n} W_{ji}(z)X_i(z) \quad j = 1, \ldots, m \qquad \text{(Equation 34)}$$

The signal estimate $\hat{S}(z)$ may approximate the original signal S(z) up to an arbitrary permutation and an arbitrary convolution. If the mixing transfer functions $h_{ij}(t)$ are expressed in the Z-domain, the overall system transfer function can be formulated as $$w(z)H(z)=PD(z) \qquad \text{(Equation 35)}$$

where P is a permutation matrix and D(z) is a diagonal transfer function matrix. The elements on the diagonal of D(z) are transfer functions rather than scalars (as represented in instantaneous BSS).

Blind Source Separation—Decorrelation

Figure 12:
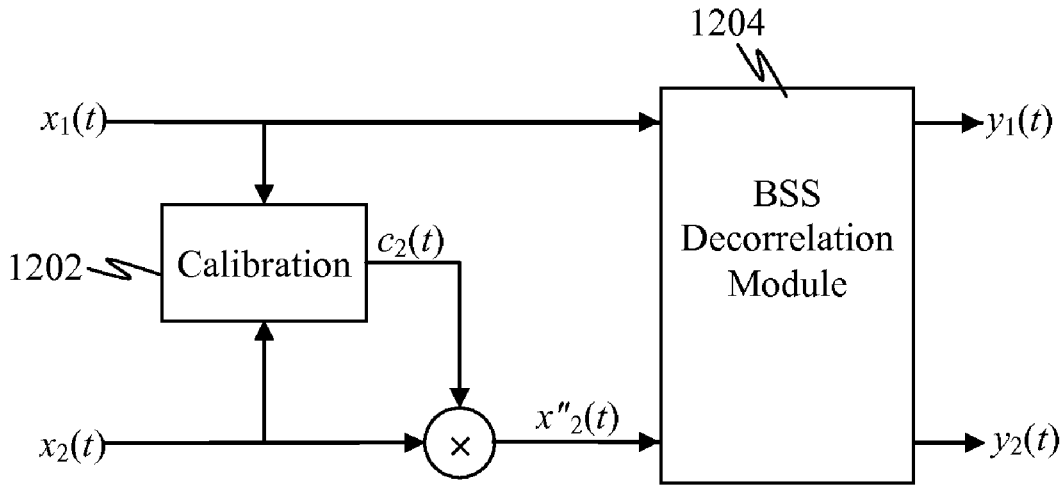
FIG. 12 is a block diagram illustrating a first example of how signals may be calibrated after a beamforming pre-processing stage but before a blind source separation stage.

Referring again to FIG. 3, because the original input signals $s_1(t)$ and $s_2(t)$ can be highly correlated, the signal level of the second output $x_2(t)$ can be low after the beamforming module 302. This may reduce the convergence rate of the blind source separation module 304. In order to maximize the convergence rate of the blind source separation module 304, a second calibration may be used before the blind source separation. FIG. 12 is a block diagram illustrating a first example of how signals may be calibrated after a beamforming pre-processing stage but before a blind source separation stage 1204. Signals $x_1(t)$ and $x_2(t)$ may be provided as inputs to a calibration module 1202. In this example, the signal $x_2(t)$ is scaled by a scalar $c_2(t)$ as follows, $$\tilde{x}_2(t)=c_2(t)\cdot x_2(t) \qquad \text{(Equation 36)}$$

The scalar $c_2(t)$ may be determined based on the signals $x_1(t)$ and $x_2(t)$. For example, the calibration factor can be computed using the noise floor estimates of $x_1(t)$ and $x_2(t)$ as illustrated in FIG. 10 and Equations 27, 28, and 29.

After calibration, the desired speech signal in $x_1(t)$ is much stronger than that in $x_2(t)$. It is then possible to avoid the indeterminacy when the blind source separation algorithm is used. In practice, it is desirable to use blind source separation algorithms that can avoid signal scaling, which is another general problem of blind source separation algorithms.

Figure 13:
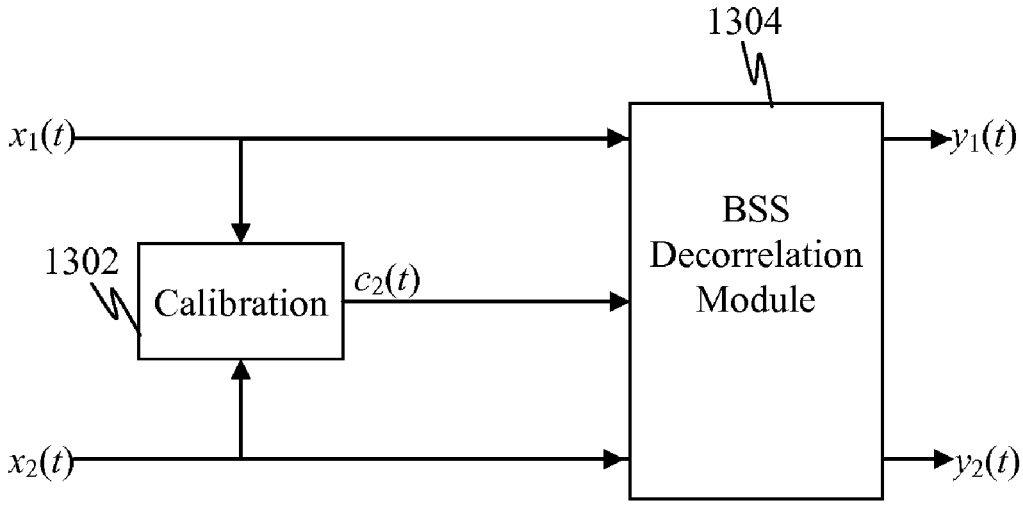
FIG. 13 is a block diagram illustrating an alternative scheme to implement signal calibration prior to blind source separation.

FIG. 13 is a block diagram illustrating an alternative scheme to implement signal calibration prior to blind source separation. Similar to the calibration process illustrated in FIG. 8, a calibration module 1302 generates a second scaling factor $c_2(t)$ to change, configure, or modify the adaptation (e.g., algorithm, weights, factors, etc.) of the blind source separation module 1304 instead of using it to scale the signal $x_2(t)$.

Blind Source Separation—Post-Processing

Referring again to FIG. 3, the one or more source signal estimates $y_1(t)$, $y_2(t)$ and $y_n(t)$ output by the blind source separation module 304 may be further processed by a post-processing module 308 that provides output signals $\hat{s}_1(t)$, $\hat{s}_2(t)$ and $\hat{s}_n(t)$. The post-processing module 308 may be added to further improve the signal-to-noise ratio (SNR) of a desired speech signal estimate. In certain cases, if the pre-conditioning calibration and beamforming module 302 produces a good estimate of the ambient noise, the blind source separation module 304 may be bypassed and the post-processing module 308 alone may produce an estimate of a desired speech signal. Similarly, the post-processing module 308 may be bypassed if the blind source separation module 304 produces a good estimate of the desired speech signal.

After the signal separation process, signals $y_1(t)$ and $y_2(t)$ are provided. Signal $y_1(t)$ may contain primarily the desired signal and somewhat attenuated ambient noise. Signal $y_1(t)$ may be referred to as a speech reference signal. The reduction of ambient noise varies depending on the environment and the characteristics of the noise. Signal $y_2(t)$ may contain primarily ambient noise, in which the desired signal has been reduced. It is also referred to as the noise reference signal.

According to various implementations of the calibration and beamforming module 302 and blind source separation module 304, a desired speech signal in the noise reference signal has been mostly removed. Therefore, the post-processing module 308 may focus on removing noise from a speech reference signal.

Figure 14:
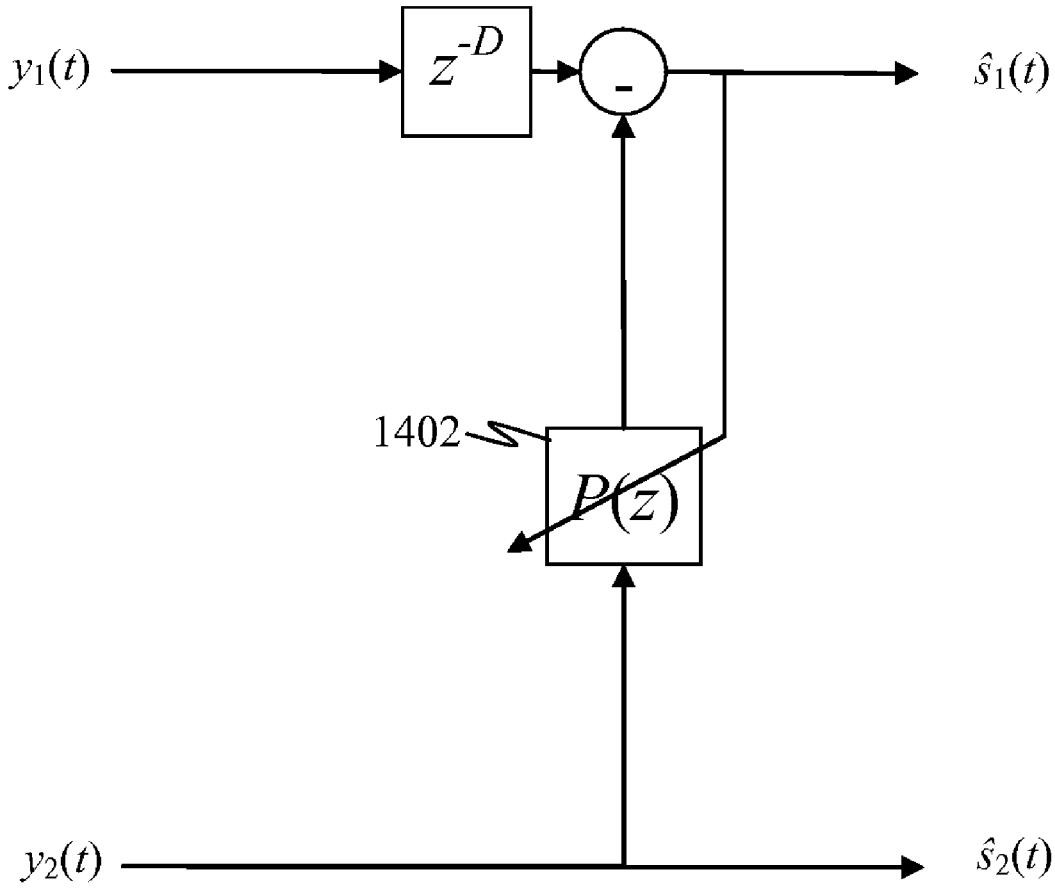
FIG. 14 is a block diagram illustrating an example of the operation of a post-processing module which is used to reduce noise from a desired speech reference signal.

FIG. 14 is a block diagram illustrating an example of the operation of a post-processing module which is used to reduce noise from a desired speech reference signal. A non-causal adaptive filter 1402 may be used to further reduce noise in speech reference signal $y_1(t)$. Noise reference signal $y_2(t)$ may be used as an input to the adaptive filter 1402. The delayed signal $y_1(t)$ may be used as a reference to the adaptive filter 1402. The adaptive filter P(z) 1402 can be adapted using a Least Means Square (LMS) type adaptive filter or any other adaptive filter. Consequently, the post-processing module may be able to provide an output signal $\hat{s}_1(t)$ containing a desired speech reference signal with reduced noise.

In a more general sense, the post-processing module 308 may perform noise calibration on the output signals $y_1(t)$ and $y_2(t)$, as illustrated in FIG. 2 post processing stage 215.

Example Method

Figure 15:
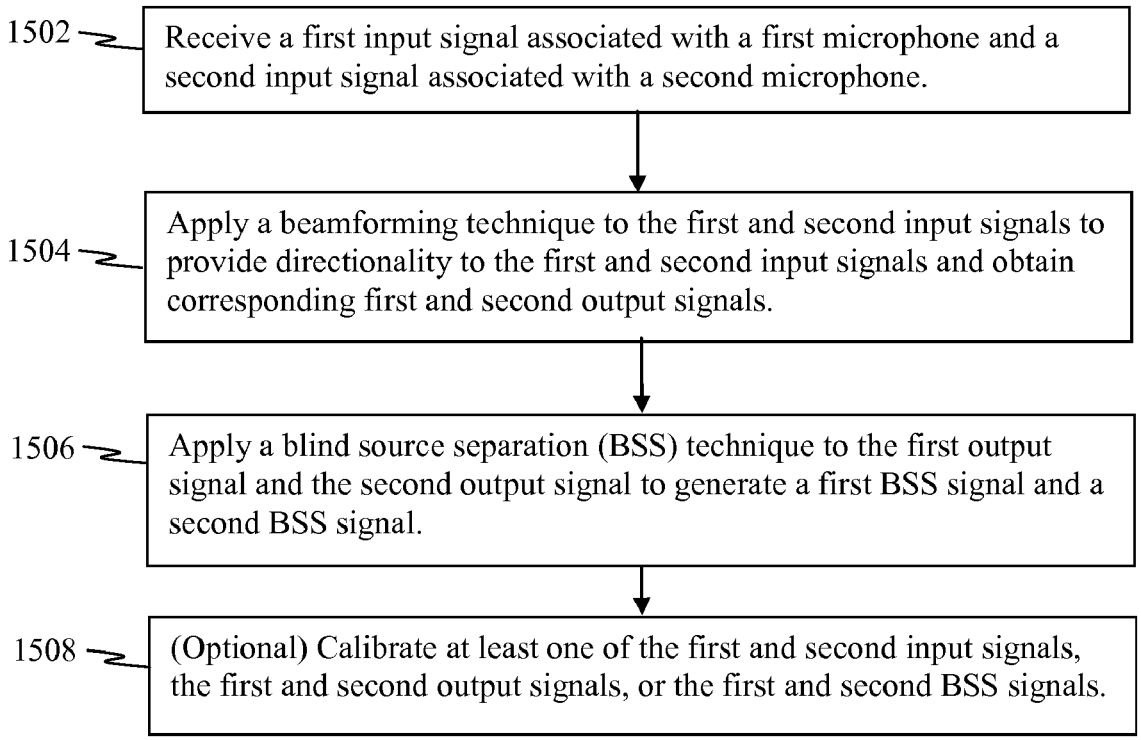
FIG. 15 is a flow diagram illustrating a method to enhance blind source separation according to one example.

FIG. 15 is a flow diagram illustrating a method to enhance blind source separation according to one example. A first input signal associated with a first microphone and a second input signal associated with a second microphone may be received or obtained 1502. The first and second input signals may be pre-processed by calibrating the first and second input signals and applying a beamforming technique to provide directionality to the first and second input signals and obtain corresponding first and second output signals 1504. That is, the beamforming technique may include the techniques illustrated in FIGS. 4, 5, 6, 7, 8, 9, and/or 10, among other beamforming techniques. For instance, in a two microphone system, the beamforming technique generates a first and second output signals such that a sound signal from the desired direction may be amplified in the first output signal of the beamformer while the sound signal from the desired direction is suppressed in the second output signal of the beamformer.

In one example, the beamforming technique may include applying an adaptive filter to the second input signal, subtracting the first input signal from the second input signal, and/or adding the filtered second input signal to the first input signal (as illustrated in FIG. 9 for example).

In another example, the beamforming technique may include generating a calibration factor based on a ratio of energy estimates of the first input signal and second input signal, and applying the calibration factor to one of either the first input signal or the second input signal (as illustrated in FIGS. 5 and 6 for example).

Alternatively, in another example, the beamforming technique may include generating a calibration factor based on a ratio of a cross-correlation estimate between the first and second input signals and an energy estimate of the second input signal, and applying the calibration factor to at least one of either the first input signal or the second input signal (as illustrated in FIGS. 5, 7 and 8 for example).

In yet another example, the beamforming technique may include (a) adding the second input signal to the first input signal to obtain a modified first signal, (b) subtracting the first input signal from the second input signal to obtain a modified second signal, (c) obtaining a first noise floor estimate for the modified first signal, (d) obtaining a second noise floor estimate for the modified second signal, (e) generating a calibration factor based on a ratio of the first noise floor estimate and the second noise floor estimate, (f) applying the calibration factor to the modified second signal, and/or (g) applying an adaptive filter to the modified first signal and subtracting the filtered modified first signal from the modified second signal (as illustrated in FIG. 10 for example) to obtain corresponding first and second output signals.

A blind source separation (BSS) technique may then be applied to the pre-processed first output signal and the pre-processed second output signal to generate a first BSS signal and a second BSS signal 1506. In one example, a pre-calibration may be performed on one or more of the output signals prior to applying the blind source separation technique by (a) obtaining a calibration factor based on the first and second output signals, and (b) calibrating at least one of the first and second output signals prior to applying blind source separation technique to the first and second output signals (as illustrated in FIG. 12 for example). In another example, pre-calibration that may be performed prior to applying the blind source separation technique includes (a) obtaining a calibration factor based on the first and second output signals, and (b) modifying the operation of the blind source separation technique based on the calibration factor (as illustrated in FIG. 13 for example).

At least one of the first and second input signals, the first and second output signals, or the first and second BSS signals may be optionally calibrated 1508. For example, a first calibration (e.g., pre-processing stage calibration 208 in FIG. 2) may be applied to at least one of the first and second input signals as either amplitude-based calibration or cross-correlation-based calibration. Additionally, a second calibration (e.g., interim-processing stage calibration 213 in FIG. 2) may be applied to at least one of the first and second output signals from the beamforming stage as either amplitude-based calibration or cross-correlation-based calibration.

Additionally, a third calibration (e.g., post-processing stage calibration 215 in FIG. 2) may be applied to at least one of the first and second BSS signals from the blind source separation stage as noise-based calibration. For instance, an adaptive filter may be applied (in a post-processing stage calibration) to the first BSS signal to reduce noise in the first BSS signal, wherein the second BSS signal is used an input to the adaptive filter 1508. In one example, of the post-processing stage calibration, an adaptive filter is applied to the first BSS signal to reduce noise in the first BSS signal, wherein the second BSS signal is used an input to the adaptive filter (as illustrated in FIG. 14 for example).

According to yet another configuration, a circuit in a mobile device may be adapted to receive a first input signal associated with a first microphone. The same circuit, a different circuit, or a second section of the same or different circuit may be adapted to receive a second input signal associated with a second microphone. In addition, the same circuit, a different circuit, or a third section of the same or different circuit may be adapted to apply a beamforming technique to the first and second input signals to provide directionality to the first and second input signals and obtain corresponding first and second output signals. The portions of the circuit adapted to obtain the first and second input signals may be directly or indirectly coupled to the portion of the circuit(s) that apply beamforming to the first and second input signals, or it may be the same circuit. A fourth section of the same or a different circuit may be adapted to apply a blind source separation (BSS) technique to the first output signal and the second output signal to generate a first BSS signal and a second BSS signal. Optionally, a fifth section of the same or a different circuit may be adapted to calibrate at least one of the first and second input signals, the first and second output signals, or the first and second BSS signals. The beamforming technique may apply different directionality to the first input signal and second input signal and the different directionality amplifies sound signals from a first direction while attenuating sound signals from other directions (e.g., from an orthogonal or opposite direction). One of ordinary skill in the art will recognize that, generally, most of the processing described in this disclosure may be implemented in a similar fashion. Any of the circuit(s) or circuit sections may be implemented alone or in combination as part of an integrated circuit with one or more processors. The one or more of the circuits may be implemented on an integrated circuit, an Advance RISC Machine (ARM) processor, a digital signal processor (DSP), a general purpose processor, etc.

One or more of the components, steps, and/or functions illustrated in FIGS. 1, 2, 3, 4, 5, 6, 7, 8, 9, 10, 11, 12, 13, 14 and/or 15 may be rearranged and/or combined into a single component, step, or function or embodied in several components, steps, or functions. Additional elements, components, steps, and/or functions may also be added. The apparatus, devices, and/or components illustrated in FIGS. 1, 2, 3, 4, 5, 8, 9, 10, 11, 12, 13 and/or 14 may be configured to perform one or more of the methods, features, or steps described in FIGS. 6, 7 and/or 15. The novel algorithms described herein may be efficiently implemented in software and/or embedded hardware.

Those of skill in the art would further appreciate that the various illustrative logical blocks, modules, circuits, and algorithm steps described in connection with the configurations disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system.

The various features described herein can be implemented in different systems. For example, the beamforming stage and blind source separation stage may be implemented in a single circuit or module, on separate circuits or modules, executed by one or more processors, executed by computer-readable instructions incorporated in a machine-readable or computer-readable medium, and/or embodied in a handheld device, mobile computer, and/or mobile phone.

It should be noted that the foregoing configurations are merely examples and are not to be construed as limiting the claims. The description of the configurations is intended to be illustrative, and not to limit the scope of the claims. As such, the present teachings can be readily applied to other types of apparatuses and many alternatives, modifications, and variations will be apparent to those skilled in the art.

What is claimed is:

1. A method comprising:

receiving a first input signal associated with a first microphone and a second input signal associated with a second microphone;

applying a beamforming technique to the first and second input signals to provide directionality to the first and second input signals and obtain corresponding first and second output signals;

applying a blind source separation (BSS) technique to the first output signal and second output signal to generate a first BSS signal and a second BSS signal; and calibrating at least one of:

the first and second input signals prior to applying the beamforming technique, and the first and second output signals after applying the beamforming technique but prior to applying the blind source separation technique.

2. The method of claim 1, wherein the beamforming technique provides directionality to the first and second input signals by applying spatial filters to the first and second input signals.

3. The method of claim 2, wherein applying spatial filters to the first and second input signals amplifies sound signals from a first direction while attenuating sound signals from other directions.

4. The method of claim 2, wherein applying spatial filter to the first and second input signals amplifies a desired speech signal in the resulting first output signal and attenuates the desired speech signal in the second output signal.

5. The method of claim 1, wherein calibrating at least one of the first and second input signals comprises applying an adaptive filter to the second input signal, and applying the beamforming technique includes subtracting the first input signal from the second input signal.

6. The method of claim 5, wherein applying the beamforming technique further comprises adding the filtered second input signal to the first input signal.

7. The method of claim 1, wherein calibrating at least one of the first and second input signals further comprises:

generating a calibration factor based on a ratio of energy estimates of the first input signal and second input signal; and applying the calibration factor to at least one of either the first input signal or the second input signal.

8. The method of claim 1, wherein calibrating at least one of the first and second input signals further comprises:

generating a calibration factor based on a ratio of a cross-correlation estimate between the first and second input signals and an energy estimate of the second input signal; and applying the calibration factor to the second input signal.

9. The method of claim 1, wherein calibrating at least one of the first and second input signals further comprises:

generating a calibration factor based on a ratio of a cross-correlation estimate between the first and second input signals and an energy estimate of the first input signal; and applying the calibration factor to the first input signal.

10. The method of claim 1, wherein calibrating at least one of the first and second input signals further comprises:

generating a calibration factor based on a cross-correlation between first and second input signals and an energy estimate of the second input signal;

multiplying the second input signal by the calibration factor; and dividing the first input signal by the calibration factor.

11. The method of claim 1, wherein applying the beamforming technique to the first and second input signals further comprises:

adding the second input signal to the first input signal to obtain a modified first signal; and subtracting the first input signal from the second input signal to obtain a modified second signal.

12. The method of claim 11, wherein calibrating at least one of the first and second input signals further comprises:

obtaining a first noise floor estimate for the modified first signal;

obtaining a second noise floor estimate for the modified second signal;

generating a calibration factor based on a ratio of the first noise floor estimate and the second noise floor estimate; and applying the calibration factor to the modified second signal.

13. The method of claim 12, further comprising:

applying an adaptive filter to the modified first signal and subtracting the filtered modified first signal from the modified second signal.

14. The method of claim 1, further comprising:

obtaining a calibration factor based on the first and second output signals; and calibrating at least one of the first and second output signals prior to applying the blind source separation technique to the first and second output signals.

15. The method of claim 1, further comprising:

obtaining a calibration factor based on the first and second output signals; and modifying the operation of the blind source separation technique based on the calibration factor.

16. The method of claim 1, further comprising:

applying an adaptive filter to the first BSS signal to reduce noise in the first BSS signal, wherein the second BSS signal is used an input to the adaptive filter.

17. The method of claim 1, wherein calibrating at least one of the first and second input signals includes applying at least one of amplitude-based calibration or cross correlation-based calibration.

18. The method of claim 1, wherein calibrating at least one of the first and second output signals includes applying at least one of amplitude-based calibration or cross correlation-based calibration.

19. The method of claim 1, wherein calibrating at least one of the first and second BSS signals includes applying noise-based calibration.

20. A communication device comprising:

a first microphone configured to obtain a first input signal;

a second microphone configured to obtain a second input signal;

a beamforming module configured to perform beamforming on the first and second input signals to obtain corresponding first and second output signals;

a blind source separation module configured to perform a blind source separation (BSS) technique to the first output signal and the second output signal to generate a first BSS signal and a second BSS signal; and at least one calibration module configured to calibrate at least one of:

the first and second input signals prior to performing beamforming, and the first and second output signals after performing beamforming but prior to performing the blind source separation technique.

21. The communication device of claim 20, wherein the beamforming module performs beamforming by applying spatial filters to the first and second input signals, wherein applying a spatial filter to the first and second input signals amplifies sound signals from a first direction while attenuating sound signals from other directions.

22. The communication device of claim 21, wherein applying spatial filters to the first input signal and second input signal amplifies a desired speech signal in the first output signal and attenuates the desired speech signal in the second output signal.

23. The communication device of claim 20, wherein performing beamforming on the first and second input signals, the beamforming module is further configured to apply an adaptive filter to the second input signal;

subtract the first input signal from the second input signal; and add the filtered second input signal to the first input signal.

24. The communication device of claim 20, wherein calibrating at least one of the first and second input signals, the calibration module is further configured to generate a calibration factor based on a ratio of a cross-correlation estimate between the first and second input signals and an energy estimate of the second input signal; and apply the calibration factor to the second input signal.

25. The communication device of claim 20, wherein calibrating at least one of the first and second input signals, the calibration module is further configured to generate a calibration factor based on a ratio of a cross-correlation estimate between the first and second input signals and an energy estimate of the first input signal; and apply the calibration factor to the first input signal.

26. The communication device of claim 20, wherein calibrating at least one of the first and second input signals, the calibration module is further configured to generate a calibration factor based on a cross-correlation between first and second input signals and an energy estimate of the second input signal;

multiply the second input signal by the calibration factor; and divide the first input signal by the calibration factor.

27. The communication device of claim 20, wherein performing beamforming on the first and second input signals, the beamforming module is further configured to add the second input signal to the first input signal to obtain a modified first signal;

subtract the first input signal from the second input signal to obtain a modified second signal;

obtain a first noise floor estimate for the modified first signal;

obtain a second noise floor estimate for the modified second signal; and the calibration module is further configured to generate a calibration factor based on a ratio of the first noise floor estimate and the second noise floor estimate; and apply the calibration factor to the modified second signal.

28. The communication device of claim 20, further comprising:

a post-processing module configured to apply an adaptive filter to the first BSS signal to reduce noise in the first BSS signal, wherein the second BSS signal is used as an input to the adaptive filter.

29. The communication device of claim 20, wherein the at least one calibration module includes a first calibration module configured to apply at least one of amplitude-based calibration or cross correlation-based calibration to the first and second input signals.

30. The communication device of claim 20, wherein the at least one calibration module includes a second calibration module configured to apply at least one of amplitude-based calibration or cross correlation-based calibration to the first and second output signals.

31. The communication device of claim 20, wherein the at least one calibration module includes a third calibration module configured to apply noise-based calibration to the first and second BSS signals.

32. A communication device comprising:

means for receiving a first input signal associated with a first microphone and a second input signal associated with a second microphone;

means for applying a beamforming technique to the first and second input signals to provide directionality to the first and second input signals and obtain corresponding first and second output signals;

means for applying a blind source separation (BSS) technique to the first output signal and second output signal to generate a first BSS signal and a second BSS signal; and means for calibrating at least one of:

the first and second input signals prior to applying the beamforming technique, and the first and second output signals after applying the beamforming technique but prior to applying the blind source separation technique.

33. The communication device of claim 32, further comprising:

means for applying an adaptive filter to the first BSS signal to reduce noise in the first BSS signal, wherein the second BSS signal is used an input to the adaptive filter.

34. The communication device of claim 32, further comprising:

means for applying an adaptive filter to the second input signal;

means for subtracting the first input signal from the second input signal; and means for adding the filtered second input signal to the first input signal.

35. The communication device of claim 32, further comprising:

means for obtaining a calibration factor based on the first and second output signals; and means for calibrating at least one of the first and second output signals prior to applying blind source separation technique to the first and second output signals.

36. The communication device of claim 32, further comprising:

means for obtaining a calibration factor based on the first and second output signals; and means for modifying the operation of the blind source separation technique based on the calibration factor.

37. A circuit for enhancing blind source separation of two or more signals, wherein the circuit is adapted to receive a first input signal associated with a first microphone and a second input signal associated with a second microphone;

apply a beamforming technique to the first and second input signals to provide directionality to the first and second input signals and obtain corresponding first and second output signals;

apply a blind source separation (BSS) technique to the first output signal and the second output signal to generate a first BSS signal and a second BSS signal; and calibrate at least one of:

the first and second input signals prior to applying the beamforming technique, and the first and second output signals after applying the beamforming technique but prior to applying the blind source separation technique.

38. The circuit of claim 37, wherein the beamforming technique applies spatial filtering to the first input signal and second input signal and the spatial filter amplifies sound signals from a first direction while attenuating sound signals from other directions.

39. The circuit of claim 37, wherein the circuit is an integrated circuit.

40. A computer-readable medium comprising instructions for enhancing blind source separation of two or more signals, which when executed by a processor causes the processor to obtain a first input signal associated with a first microphone and a second input signal associated with a second microphone;

apply a beamforming technique to the first and second input signals to provide directionality to the first and second input signals and obtain corresponding first and second output signals;

apply a blind source separation (BSS) technique to the pre-processed first signal and pre-processed second signal to generate a first BSS signal and a second BSS signal; and calibrate at least one of:

the first and second input signals, signals prior to applying the beamforming technique, and the first and second output signals, or the first and second BSS signals after applying the beamforming technique but prior to applying the blind source separation technique.

* * * * *